US012687371B2

(12) United States Patent
Zhu

(10) Patent No.: US 12,687,371 B2
(45) Date of Patent: Jul. 21, 2026

(54) AIR GUN WITH ONBOARD ELECTRIC PUMP

(71) Applicant: New Swan Technology Co., Ltd., Zhongshan (CN)

(72) Inventor: Zuopeng Zhu, Zhongshan (CN)

(73) Assignee: New Swan Technology Co., Ltd., Zhongshan (CN)

( * ) Notice: Subject to any disclaimer, the term of this patent is extended or adjusted under 35 U.S.C. 154(b) by 0 days.

(21) Appl. No.: 18/805,540

(22) Filed: Aug. 15, 2024

(65) Prior Publication Data

US 2026/0043633 A1 Feb. 12, 2026

(30) Foreign Application Priority Data

Aug. 12, 2024 (CN) ..... 202421947933.7

(51) Int. Cl.
*F41B 11/681* (2013.01)
*F41B 11/723* (2013.01)

(52) U.S. Cl.
CPC ..... *F41B 11/681* (2013.01); *F41B 11/723* (2013.01)

(58) Field of Classification Search
CPC ..... F41B 11/681
USPC ..... 124/75, 76, 77
See application file for complete search history.

(56) References Cited

U.S. PATENT DOCUMENTS

2005/0000505 A1* 1/2005 Pedicini ..... F04B 9/02 124/63
2020/0141672 A1* 5/2020 Silva ..... F41B 11/71

FOREIGN PATENT DOCUMENTS

WO WO-2023177817 A1 * 9/2023 ..... F41B 11/681

* cited by examiner

*Primary Examiner* — Bret Hayes
(74) *Attorney, Agent, or Firm* — BAYES PLLC

(57) ABSTRACT

The present disclosure provides an air gun, including: an air tube assembly; an onboard electric pump assembly mounted within the air gun and connected to the air tube assembly, where the onboard electric pump assembly is configured to charge high-pressure air into the air tube assembly; a valve assembly configured to control air flow and pressure within the air tube assembly; a firing mechanism assembly operable by a user of the air gun; and an air release valve assembly located between the air tube assembly and the firing mechanism assembly. When the user operates the firing mechanism assembly, the air release valve assembly is automatically triggered by the firing mechanism assembly to release the high-pressure air in the air tube assembly to project pellets.

16 Claims, 15 Drawing Sheets

AIR GUN WITH ONBOARD ELECTRIC PUMP

CROSS-REFERENCE TO RELATED APPLICATION

This application claims the priority of Chinese Patent Application No. 202421947933.7 filed on Aug. 12, 2024, the entire content of which is hereby incorporated by reference.

TECHNICAL FIELD

The present disclosure relates to the field of air gun, and more particularly, to an air gun with an onboard electric pump.

BACKGROUND

Air guns have been popular for recreational shooting, hunting, and target practice due to their relatively low cost, ease of use, and safety compared to traditional firearms. Among the various types of air guns, Pre-Charged Pneumatic (PCP) air guns have gained significant popularity due to their ability to provide high power and consistent performance. PCP air guns typically utilize a reservoir of compressed air that propels the pellet or projectile when the trigger is pulled.

One of the significant challenges in the current PCP air gun technology is the inconvenience and inefficiency of existing air charging systems. Most PCP air guns rely on external equipment, such as hand pumps or bulky air compressors, to recharge the air reservoir. This reliance on external equipment makes the system less portable and more cumbersome for users, particularly in the field or remote locations where carrying additional equipment is impractical.

Another challenge is the lack of integrated control over the air charging process within the PCP air gun. Existing systems do not allow for the air pump to be controlled seamlessly by the air gun's onboard controller. This lack of integration prevents users from utilizing a unified interface to manage and monitor the air charging process. Users are unable to benefit from visual feedback and precise control over the pressure levels within an air tube assembly of the PCP air gun, which can compromise both performance and safety.

Furthermore, there is a pressing need for a system that can monitor and control the pressure within the air tube assembly to ensure optimal performance and safety. Without the ability to accurately monitor and adjust pressure levels, users may face inconsistent performance or even safety hazards due to over-pressurization.

These challenges call for a compact, efficient, and user-friendly onboard air charging system that can quickly and reliably recharge the air reservoir without requiring external equipment. Moreover, there is a need for a system that can monitor and control the pressure within the air tube assembly to ensure optimal performance and safety. This application provides an improved air gun equipped with an onboard electric pump.

SUMMARY

A first aspect of the present disclosure provides an air gun. The air gun includes: an air tube assembly; an onboard electric pump assembly mounted within the air gun and connected to the air tube assembly, where the onboard electric pump assembly is configured to charge high-pressure air into the air tube; a valve assembly configured to control air flow and pressure within the air tube assembly; a firing mechanism assembly operable by a user of the air gun; and an air release valve assembly located between the air tube assembly and the firing mechanism assembly. When the user operates the firing mechanism assembly, the air release valve assembly is automatically triggered by the firing mechanism assembly to release the high-pressure air in the air tube assembly to project pellets.

In some embodiments, the onboard electric pump assembly includes a multi-stage air pumping assembly configured to sequentially increase air pressure in multiple stages to a predetermined level before charging the air tube assembly.

In some embodiments, the onboard electric pump assembly further includes a gearbox assembly, and the gearbox assembly includes a set of bevel gears configured to drive pumping actions for the multi-stage air pumping assembly.

In some embodiments, the onboard electric pump assembly further includes a battery and a high-speed DC motor powered by the battery.

In some embodiments, the onboard electric pump assembly further includes a controller, and the controller is operable by the user through a user interface.

In some embodiments, the controller is connected to a pressure monitor system, and the pressure monitor system is configured to monitor pressure in the multi-stage air pumping assembly and monitor pressure in the air tube assembly.

In some embodiments, the controller is configured to, in response to a first input from the user on the user interface, start the high-speed DC motor to charge the air tube assembly.

In some embodiments, the controller is configured to, in response to a second input from the user on the user interface while the onboard electric pump assembly is charging the air tube assembly, stop the onboard electric pump assembly.

In some embodiments, the controller is configured to, in response to pressure drop in the air tube assembly below a first threshold value, start the onboard electric pump assembly to charge the air tube assembly.

In some embodiments, the controller is configured to, in response to the pressure in the air tube assembly reaches a second threshold value while the onboard electric pump assembly is charging the air tube assembly, automatically stop the onboard electric pump assembly, and the second threshold value is larger than the first threshold value.

In some embodiments, the multi-stage air pumping assembly includes a set of multi-stage tubes including: a first-stage tube; a second-stage tube enveloped by the first-stage tube; and a third-stage tube enveloped by the second-stage tube.

In some embodiments, the onboard electric pump assembly further includes: an air intake one-way valve in communication with the first-stage tube; and a mobile connection sleeve, mechanically linked to a connector of the second-stage tube, and the mobile connection sleeve is configured to move in a linear reciprocating manner, drawing air from atmosphere to pass through the air intake one-way valve, then sequentially compressing the air into the first-stage tube, the second-stage tube, the third-stage tube, and the air tube assembly.

In some embodiments, the air gun further includes a high-pressure one-way valve configured to prevent the compressed air in the air tube assembly from flowing back into the third-stage tube.

In some embodiments, the gearbox assembly includes: a first bevel gear connected to an output shaft of the high-speed DC motor of the onboard electric pump assembly; a second bevel gear connected to the first bevel gear; and a connecting rod affixed to the second bevel gear. The first bevel gear is smaller than the second bevel gear; the first bevel gear is configured to rotate in response to movement of the output shaft of the high-speed DC motor; the second bevel gear is driven to rotate by rotation of the first bevel gear; and the connecting rod is configured to translate rotation of the second bevel gear into linear reciprocating movement, enabling the multi-stage air pumping assembly to draw the air into the multi-stage tubes.

In some embodiments, the controller includes: a circuit board, equipped with the user interface; and a circuit board bracket for mounting the circuit board onto the air gun.

In some embodiments, the controller further includes: a display screen integrated into the circuit board, and the display screen is configured to display pressure in multiple units.

In some embodiments, the controller further includes: a charging interface incorporated into the circuit board, and the charging interface is configured for charging the battery of the onboard electric pump assembly.

In some embodiments, the user interface includes a set of user interface controls including an on/off button, a return button, an up-adjustment button, and a down-adjustment button for user inputs.

In some embodiments, the onboard electric pump assembly includes a two-stage air pumping assembly configured to sequentially increase air pressure in two stages to a predetermined level before charging the air tube assembly.

In some embodiments, the onboard electric pump assembly includes an air pumping assembly configured for compressing air to a predetermined level before charging the air tube assembly.

A second aspect of the present disclosure provides an onboard electric pump assembly for an air gun, including: a high-speed DC motor powered by a battery; a controller that is operable by a user through a user interface, and the controller is configured to control the high-speed DC motor; and a mounting structure to mount the high-speed DC motor within the air gun.

In some embodiments, the onboard electric pump assembly further includes a multi-stage air pumping assembly configured to sequentially increase air pressure in multiple stages to a predetermined level before charging an air tube assembly of the air gun.

In some embodiments, the onboard electric pump assembly further includes a gearbox assembly, and the gearbox assembly includes a set of bevel gears configured to drive pumping actions of the multi-stage air pumping assembly.

In some embodiments, the controller is connected to a pressure monitor system, the pressure monitor system is configured to monitor pressure in the multi-stage air pumping assembly; and monitor pressure in the air tube assembly.

In some embodiments, the controller is configured to, in response to a first input from the user on the user interface, start the high-speed DC motor to charge the air tube assembly.

In some embodiments, the controller is configured to, in response to a second input from the user on the user interface while the high-speed DC motor is charging the air tube assembly, stop the high-speed DC motor.

In some embodiments, the controller is configured to, in response to pressure drop in the air tube assembly below a first threshold value, start the high-speed DC motor to charge the air tube assembly.

In some embodiments, the controller is configured to, in response to the pressure in the air tube assembly reaches a second threshold value while the high-speed DC motor is charging the air tube assembly, automatically stop the high-speed DC motor, and the second threshold value is larger than the first threshold value.

In some embodiments, the multi-stage air pumping assembly includes a set of multi-stage tubes including: a first-stage tube; a second-stage tube enveloped by the first-stage tube; and a third-stage tube enveloped by the second-stage tube.

In some embodiments, the onboard electric pump assembly further includes an air intake one-way valve in communication with the first-stage tube and a mobile connection sleeve mechanically linked to a connector of the second-stage tube. The mobile connection sleeve is configured to move in a linear reciprocating manner, drawing air from atmosphere to pass through the air intake one-way valve, then sequentially compressing the air into the first-stage tube, the second-stage tube, the third-stage tube, and the air tube assembly.

In some embodiments, the onboard electric pump assembly further includes a high-pressure one-way valve configured to prevent the compressed air in the air tube assembly from flowing back into the third-stage tube.

In some embodiments, the gearbox assembly includes: a first bevel gear connected to an output shaft of the high-speed DC motor; a second bevel gear connected to the first bevel gear; and a connecting rod affixed to the second bevel gear. The first bevel gear is smaller than the second bevel gear; the first bevel gear is configured to rotate in response to movement of the output shaft of the high-speed DC motor; the second bevel gear is driven to rotate by rotation of the first bevel gear; and the connecting rod is configured to translate rotation of the second bevel gear into linear reciprocating movement, enabling the multi-stage pumping assembly to draw the air into the multi-stage tubes.

In some embodiments, the controller includes a circuit board, equipped with the user interface; and a circuit board bracket for mounting the circuit board onto the air gun.

In some embodiments, the controller further includes: a display screen integrated into the circuit board, and the display screen is configured to display pressure in multiple units.

In some embodiments, the controller further includes: a charging interface incorporated into the circuit board, and the charging interface is configured for charging the battery of the high-speed DC motor.

In some embodiments, the high-speed DC motor has an operating voltage adjustable according to a target pressure inside the air gun.

In some embodiments, the onboard electric pump assembly includes a two-stage air pumping assembly configured to sequentially increase air pressure in two stages to a predetermined level before charging an air tube assembly of the air gun.

In some embodiments, the onboard electric pump assembly includes an air pumping assembly configured for compressing air to a predetermined level before charging an air tube assembly of the air gun.

A third aspect of the present disclosure provides a method for charging an air gun using an onboard electric pump assembly mounted within the air gun. The method includes: activating the onboard electric pump assembly in response to an input from a user for setting a target air pressure value of an air tube assembly of the air gun; charging air, by the onboard electric pump assembly, into the air tube assembly of the air gun; and stopping the onboard electric pump assembly when a pressure in the air tube assembly reaches the target air pressure value.

In some embodiments, the input specifies a first threshold value and a second threshold value for pressure inside the air tube assembly, and the first threshold value is smaller than the second threshold value.

In some embodiments, the method further includes: detecting, by a first pressure senor, pressure drop in the air tube assembly; when the pressure drops below the first threshold value, automatically activating the onboard electric pump assembly to charge the air tube assembly; and stopping the onboard electric pump assembly when the pressure in the air tube assembly reaches the target air pressure value.

In some embodiments, the onboard electric pump assembly includes a multi-stage air pumping assembly including multi-stage tubes. Charging the air, by the onboard electric pump assembly, into the air tube assembly of the air gun includes: drawing air from atmosphere through an air intake one-way valve; compressing the air in the multi-stage tubes to sequentially increase the pressure of the air to a predetermined pressure level in the multi-stage tubes, forming a high-pressure air; and after the predetermined pressure level is reached, discharging the high-pressure air from the multi-stage tubes into the air tube assembly.

In some embodiments, discharging the high-pressure air into the air tube assembly includes: opening a high-pressure one-way valve between the multi-stage tubes and the air tube assembly, and the high-pressure one-way valve is in a closed state when the air is being compressed in the multi-stage tubes; and discharging the high-pressure air into the air tube assembly through the opened high-pressure one-way valve.

In some embodiments, the method further includes: detecting an air pressure in the air tube assembly by the first pressure sensor; and stopping charging the air tube assembly when air pressure in the air tube assembly reaches the second threshold value in the air tube assembly.

In some embodiments, the method further includes: detecting an air pressure in the multi-stage tubes by a second pressure sensor; and stopping compressing the air in the multi-stage tubes when the air pressure in the multi-stage tubes reaches a preset warning pressure.

In some embodiments, the onboard electric pump assembly includes a high-speed DC motor powered by a battery, and the method further includes: controlling an operating voltage of the high-speed DC motor to adjust based on different target pressure inside the air tube assembly.

In some embodiments, the onboard electric pump assembly further includes a gearbox assembly including: a first bevel gear connected to an output shaft of the high-speed DC motor; a second bevel gear connected to the first bevel gear, the second bevel gear being larger than the first bevel gear; and a connecting rod affixed to the second bevel gear. Forming the high-pressure air includes: starting the high-speed DC motor; rotating the first bevel gear driven by a movement of the output shaft of the high-speed DC motor; rotating the second bevel gear driven by a movement of the first bevel gear; translating rotation of the second bevel gear into linear reciprocating movement of the connecting rod; drawing air into the multi-stage tubes; and compressing the air into the high-pressure air in the multi-stage tubes.

In some embodiments, the onboard electric pump assembly includes a controller including a display screen, the method further includes displaying: the first threshold value; the second threshold value; and an instantaneous pressure value in the air tube assembly during charging the air tube assembly.

In some embodiments, the method further includes displaying pressure in multiple units.

In some embodiments, the onboard electric pump assembly includes a two-stage air pumping assembly configured to sequentially increase air pressure in two stages to a predetermined level before charging the air tube assembly.

In some embodiments, the onboard electric pump assembly includes an air pumping assembly configured to increase air pressure to a predetermined level before charging the air tube assembly.

BRIEF DESCRIPTION OF THE DRAWINGS

The accompanying drawings, which are incorporated herein and form a part of the specification, illustrate embodiments of the present disclosure and, together with the description, serve to explain the principles of the present disclosure and to enable a person skilled in the pertinent art to make and use the present disclosure.

FIG. 1B' illustrates a third general assembly diagram of an air gun equipped with an onboard electric pump assembly, in accordance with some embodiments of the present disclosure.

FIG. 1C' illustrates a fifth general assembly diagram of an air gun equipped with an onboard electric pump assembly, in accordance with some embodiments of the present disclosure.

FIG. 1D' illustrates a seventh general assembly diagram of an air gun equipped with an onboard electric pump assembly, in accordance with some embodiments of the present disclosure.

Embodiments of the present disclosure will be described with reference to the accompanying drawings.

DETAILED DESCRIPTION

Although specific configurations and arrangements are discussed, it should be understood that this is done for illustrative purposes only. A person skilled in the pertinent art will recognize that other configurations and arrangements can be used without departing from the spirit and scope of the present disclosure. It will be apparent to a person skilled in the pertinent art that the present disclosure can also be employed in a variety of other applications.

It is noted that references in the specification to "one embodiment," "an embodiment," "some embodiments," etc., indicate that the embodiment described can include a particular feature, structure, or characteristic, but every embodiment can not necessarily include the particular feature, structure, or characteristic. Moreover, such phrases do not necessarily refer to the same embodiment. Further, when a particular feature, structure or characteristic is described in connection with an embodiment, it would be within the knowledge of a person skilled in the pertinent art to affect such feature, structure, or characteristic in connection with other embodiments whether or not explicitly described.

In general, terminology can be understood at least in part from usage in context. For example, the term "one or more" as used herein, depending at least in part upon context, can be used to describe any feature, structure, or characteristic in a singular sense or can be used to describe combinations of features, structures, or characteristics in a plural sense. Similarly, terms, such as "a," "an," or "the," again, can be understood to convey a singular usage or to convey a plural usage, depending at least in part upon context. In addition, the term "based on" can be understood as not necessarily intended to convey an exclusive set of factors and may instead, allow for existence of additional factors not necessarily expressly described, again, depending at least in part on context.

It should be readily understood that the meaning of "on," "above," and "over" in the present disclosure should be interpreted in the broadest manner such that "on" not only means "directly on" something, but also includes the meaning of "on" something with an intermediate feature or a layer therebetween. Moreover, "above" or "over" not only means "above" or "over" something, but can also include the meaning it is "above" or "over" something with no intermediate feature or layer therebetween (i.e., directly on something).

Figure 1A:
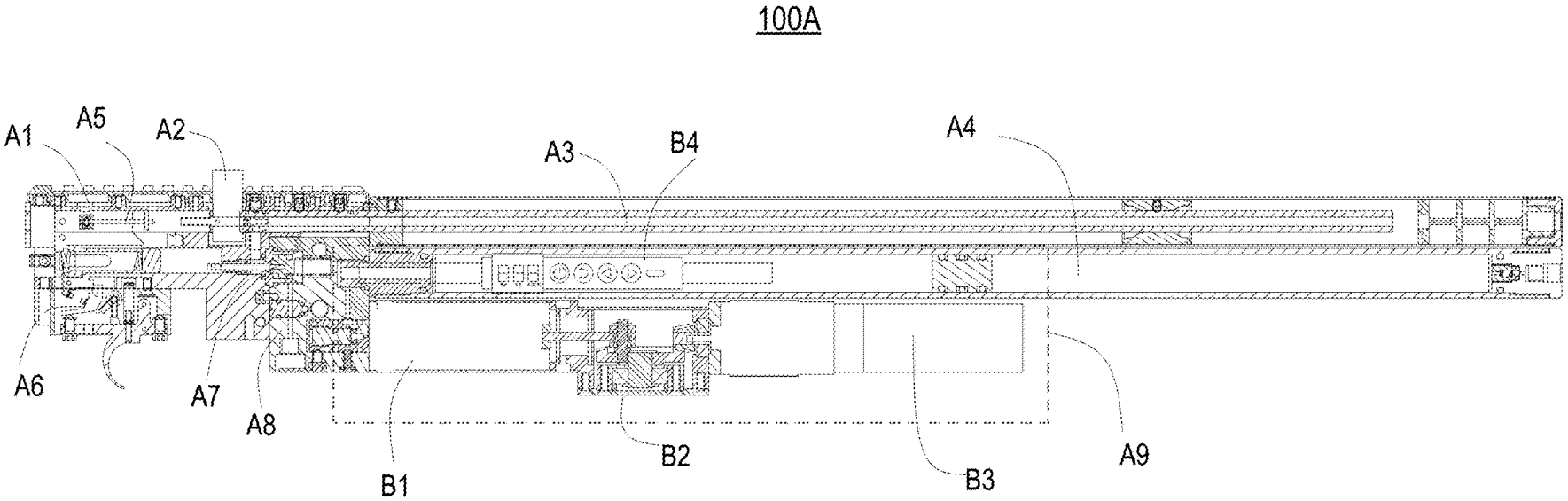
FIG. 1A illustrates a first general assembly diagram of an air gun equipped with an onboard electric pump assembly, in accordance with some embodiments of the present disclosure.

FIG. 1A illustrates a general assembly diagram of an air gun 100A equipped with an onboard electric pump assembly A9. As shown in FIG. 1A, air gun 100A may include valve assembly A1, pellet wheel assembly A2, silencer and barrel assembly A3, air tube assembly A4, bolt action mechanism assembly A5, firing mechanism assembly A6, air release valve assembly A7, connection seat assembly A8, and onboard electric pump assembly A9. The valve assembly A1 is configured to house the main valve mechanism responsible for regulating the flow of high-pressure air within the air gun 100A, ensuring consistent and precise firing of pellets. The pellet wheel assembly A2 is configured for feeding pellets into the air gun, ensuring that each pellet is properly positioned for firing.

The silencer and barrel assembly A3 includes a barrel, through which each pellet is fired, and a silencer that reduces the noise generated during firing, providing stealthy operation and enhancing user comfort. The air tube assembly A4 serves as a reservoir for storing high-pressure air, supplying high pressure to propel the pellets. The bolt action mechanism assembly A5 is a manual mechanism used to load pellets into a firing chamber and prepare the air gun 100A for firing, ensuring that the pellet is correctly seated and the firing chamber is properly sealed.

The firing mechanism assembly A6 includes a trigger and associated components that initiate a firing process. When a user pulls the trigger, the firing mechanism assembly A6 releases the high-pressure air stored in the air tube assembly A4 to fire the pellet. The air release valve assembly A7 is positioned between the air tube assembly A4 and the firing mechanism A6, and controls the release of high-pressure air when the trigger is pulled. The air release vale assembly A7 ensures that the right amount of air is used to fire each pellet, optimizing performance and efficiency of firing.

The onboard electric pump assembly A9 is a critical component configured to charge high-pressure air into the air tube assembly A4. This assembly integrates a pump body assembly B1, a gearbox B2, a motor B3, and a controller B4, working in unison to achieve efficient air compression and delivery. The onboard electric pump assembly A9 may be designed to operate in either a single stage or multiple stages, allowing it to directly or incrementally increase the air pressure to the required level with high efficiency. This flexibility in staging not only enhances the performance of the air gun by adapting to different operational conditions but also ensures consistent and reliable pressure levels, which are crucial for maintaining accuracy and power during use.

Figure 1B:
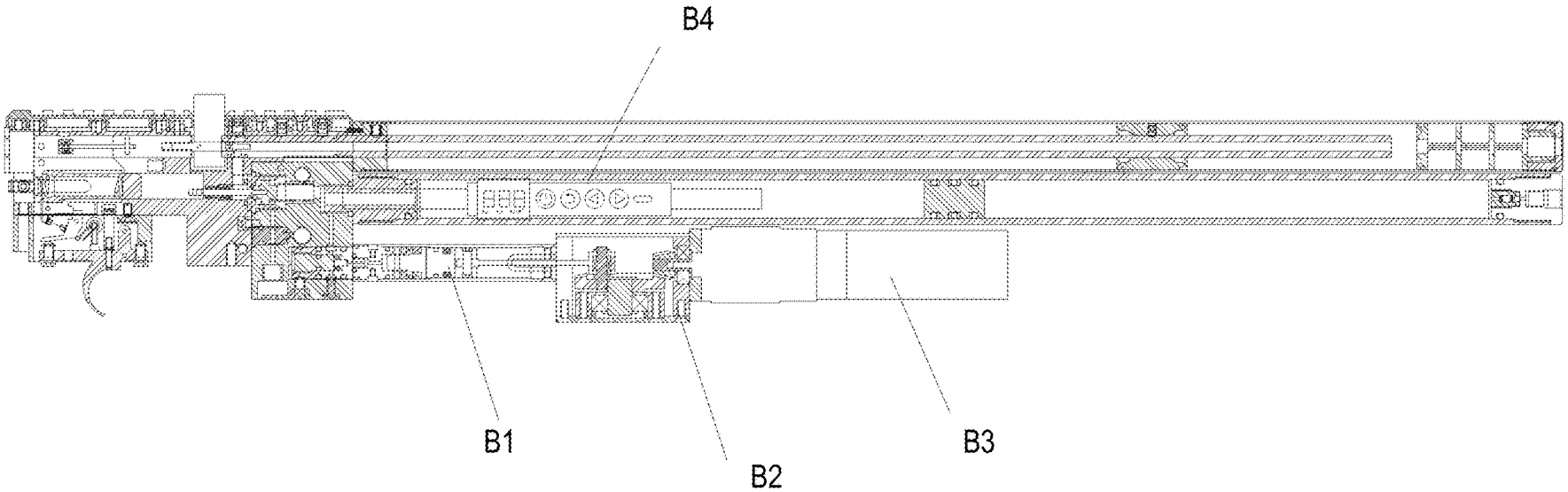
FIG. 1B illustrates a second general assembly diagram of an air gun equipped with an onboard electric pump assembly, in accordance with some embodiments of the present disclosure.
Figure 1B:
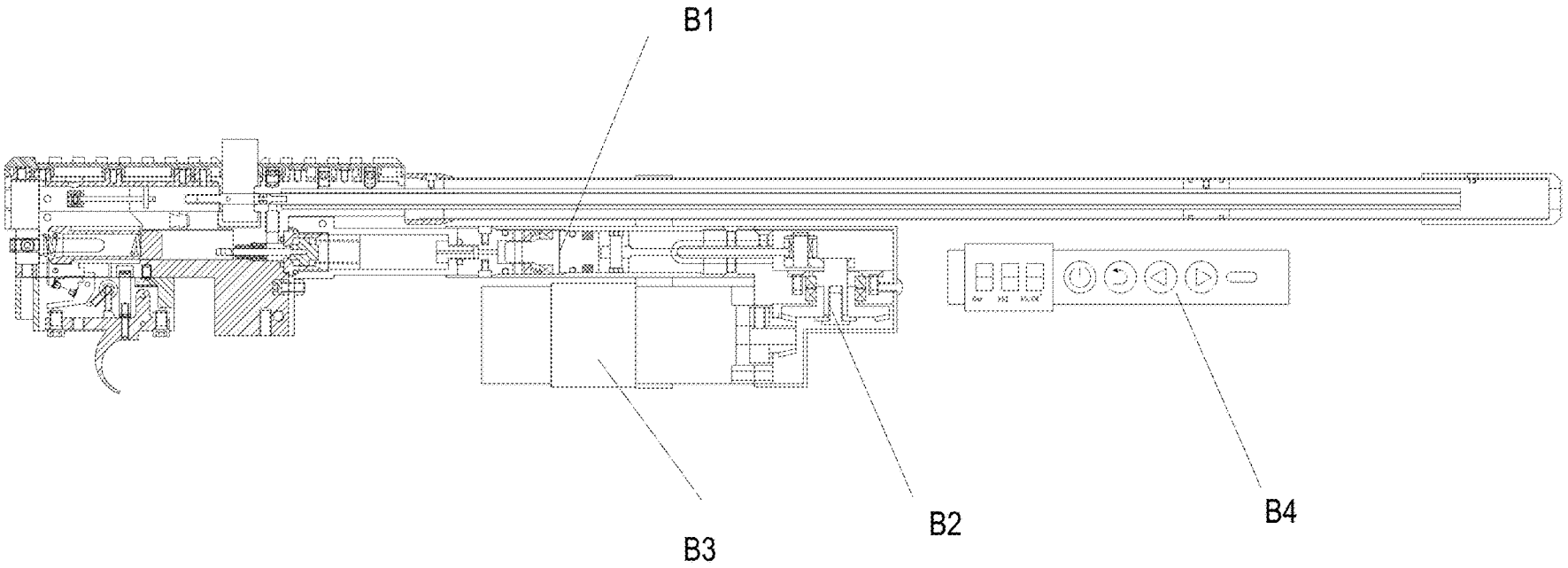

In some embodiments, the pump body assembly B1 within the onboard electric pump assembly A9 may be configured with a single-stage air pumping mechanism (as shown in FIG. 1B and FIG. 1B'). In this configuration, the pump body assembly compresses the air in a single tube, utilizing a robust and efficient design to achieve the required pressure level. While a single-stage pump may not offer the same incremental compression benefits as a multi-stage system, it simplifies the design and can be more compact and cost-effective. This configuration still leverages the high-speed DC motor and the advanced controller to ensure precise pressure control and reliable performance.

Figure 1C:
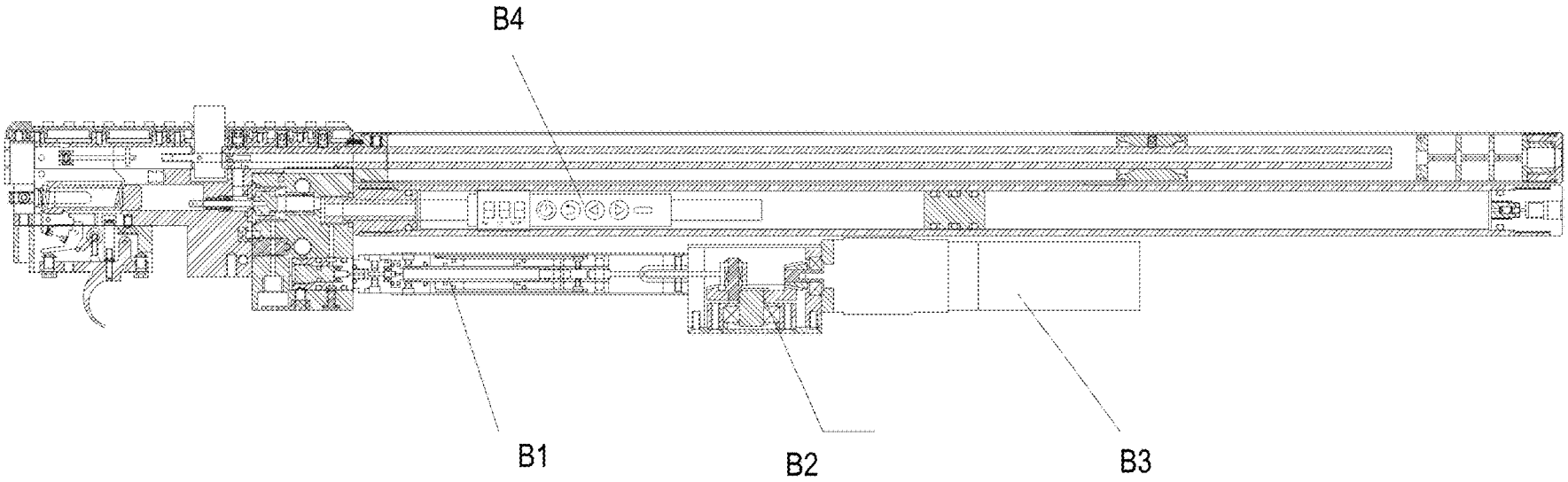
FIG. 1C illustrates a fourth general assembly diagram of an air gun equipped with an onboard electric pump assembly, in accordance with some embodiments of the present disclosure.
Figure 1C:
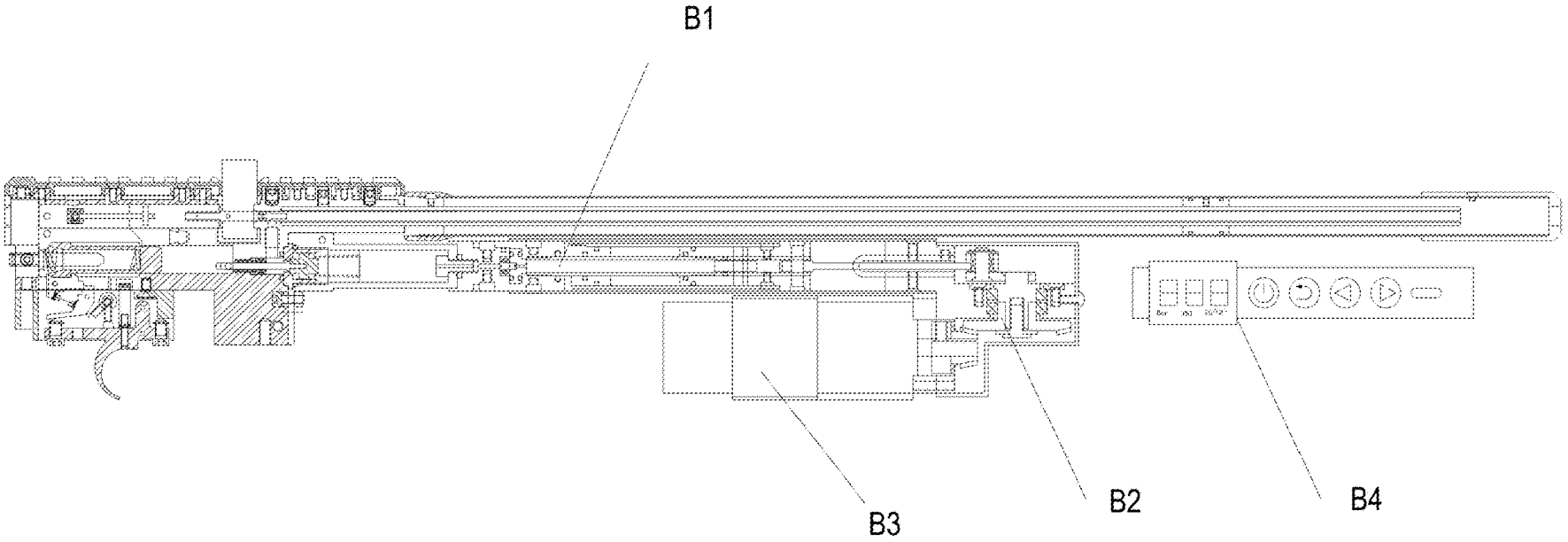
Figure 1D:
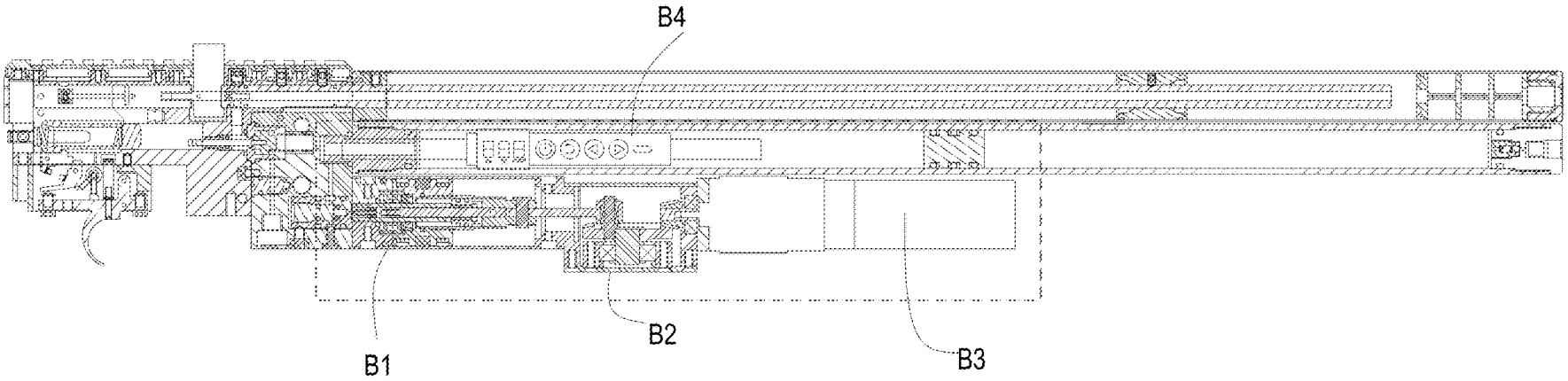
FIG. 1D illustrates a sixth general assembly diagram of an air gun equipped with an onboard electric pump assembly, in accordance with some embodiments of the present disclosure.
Figure 1D:
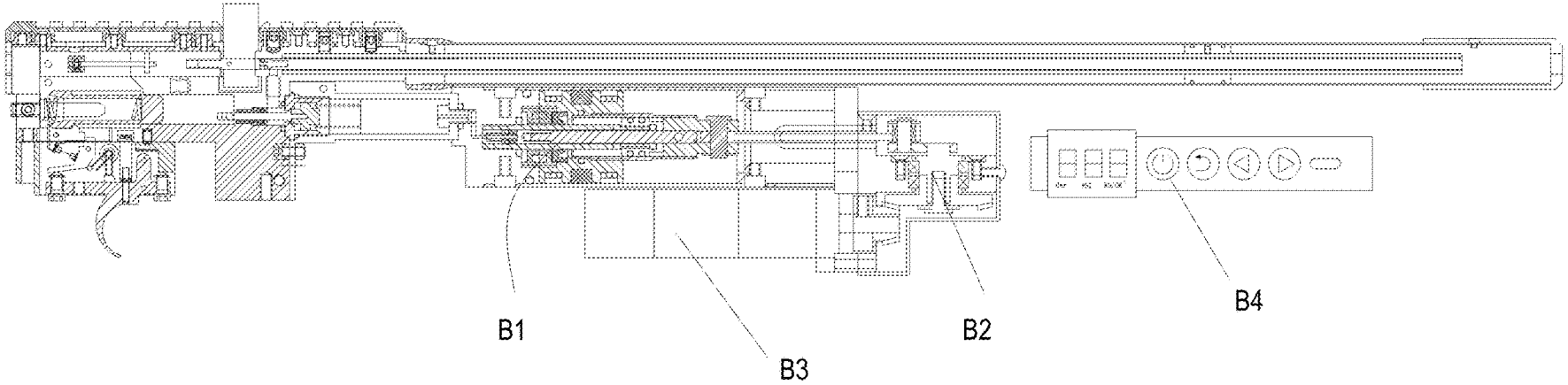

In some embodiments, the pump body assembly B1 within the onboard electric pump assembly A9 may include a multi-stage air pumping mechanism, including but not limited to two stages (as shown in FIG. 1C and FIG. 1C'), three stages (as shown in FIG. 1D and FIG. 1D'), four stages (not shown), and more. Each stage of the pump body assembly is designed to progressively compress the air, with each subsequent stage increasing the pressure further. This multi-stage design allows for efficient air compression, reducing the workload on each individual stage and minimizing the wear and tear on the pump components. The result is a highly durable and reliable air pumping system that can withstand repeated use without significant degradation in performance.

The gearbox B2 is an essential component that modulates the speed and torque generated by the motor B3. The gearbox B2 can include different gear types and configurations to suit specific needs. In some embodiments, bevel gears might be used for applications requiring speed reduction and torque increase. In some embodiments, spur gears may be used for direct power transmission.

The motor B3 within the onboard electric pump assembly A9 is a fundamental component of the onboard electric pump assembly. The motor B3 is responsible for driving the air and enabling the compression of air within the air gun. The motor B3 can vary in types, models, voltages, and power ratings, which allows it to be adapted to different operational requirements. For example, a high-power motor might be used for applications requiring rapid air compression, while a lower power motor might be sufficient for less demanding tasks.

The motor B3 may be powered by a battery. The battery can vary in types, voltages, and capacities, allowing the air gun to be tailored to different operational durations and power requirements. In some embodiments, a larger capacity battery might be selected for extended use in remote locations where recharging opportunities are limited. The flexibility in battery selection ensures that the air gun can be adapted to various power needs and operating environments.

The controller B4 integrated into the onboard electric pump assembly A9 is equipped with advanced monitoring and control capabilities. It interfaces with a user-friendly display and control panel, allowing users to set desired pressure levels, monitor real-time pressure readings, and receive alerts for anomalies or maintenance needs. The controller ensures that the air pump operates within safe parameters, automatically stopping the pump when the target pressure is reached or if any issues are detected. This intelligent control system enhances user safety and ensures optimal performance of the air gun.

The spatial arrangement and layout of the pump body assembly B1, the gearbox B2, the motor B3, and the controller B4 within the air gun can vary. The configuration of these components is crucial for optimizing the system's performance and ensuring ease of maintenance. The flexible arrangement of the pump body assembly B1, the gearbox B2, the motor B3, and the controller B4 within the air gun allows for different positioning layouts depending on the specific requirements of the application. These components can be arranged in various configurations to optimize space, weight distribution, and accessibility.

In some embodiments, as shown in FIG. 1A, FIG. 1B, FIG. 1C, and FIG. 1D the controller B4 may be positioned above the pump body assembly B1 and the gearbox B2, while the gearbox B2 is positioned beside the pump body assembly B1 and the motor B3 is positioned beside the gearbox B2.

In some embodiments, as shown in FIG. 1B', FIG. 1C' and FIG. 1D', the pump body assembly B1 may be positioned above the motor B3, while the gearbox B2 is positioned beside the pump body assembly B1 and the motor B3, and the controller B4 is positioned beside the gearbox B2.

The connection seat assembly A8 plays a crucial role in integrating the onboard electric pump assembly A9 with the other components of the air gun 100A. It provides structural integrity, ensuring that all parts are securely connected and that the air pathways are properly aligned and sealed. This precise alignment and sealing are essential for maintaining consistent air pressure and preventing leaks, which could otherwise compromise the performance and safety of the air gun.

The operation of the air gun 100A may begin with a user charging the air tube assembly A4 using the onboard electric pump assembly A9. Once charged, when the trigger is pulled, the firing mechanism assembly A6 activates the air release valve assembly A7, allowing the high-pressure air stored in the air tube assembly A4 to propel a pellet through the silencer and barrel A3.

In some embodiments, depending on the specific application, the air gun, for example, as shown in FIG. 1B', FIG. 1C', and FIG. 1D', may not include the air tube assembly A4. This flexibility allows the design to be adapted to various operational needs, where the presence of the air tube assembly may not be necessary or desirable. For instance, in applications where the air gun is intended for low-pressure scenarios, the air tube assembly can be omitted to simplify the design and reduce weight. This adaptability ensures that the air gun can be customized to meet a wide range of performance requirements and operational contexts.

Figure 2:
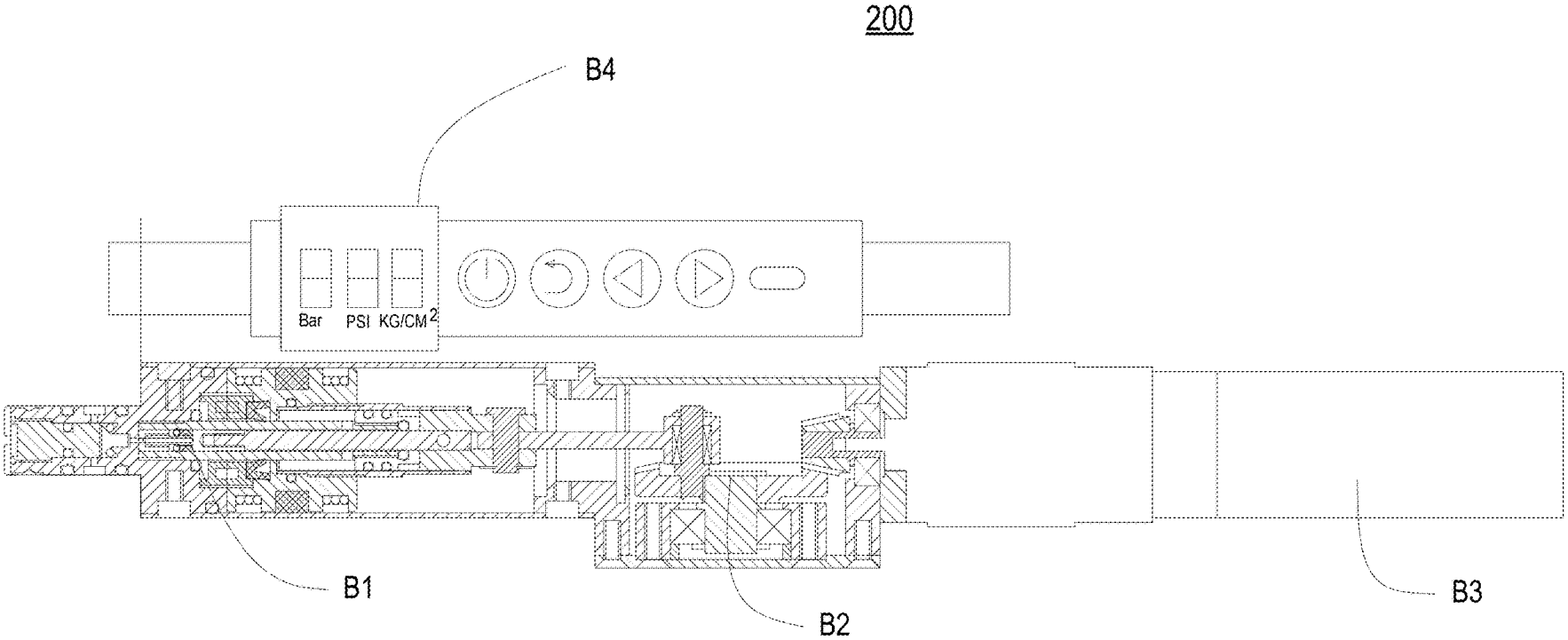
FIG. 2 illustrates an onboard electric pump assembly, in accordance with some embodiments of the present disclosure.

FIG. 2 illustrates an onboard electric pump assembly 200, in accordance with some embodiments of the present disclosure. As shown in FIG. 2, the onboard electric pump assembly 200 may include four key components: pump body assembly B1, gearbox assembly B2, motor B3, and controller B4. The onboard electric pump assembly may be integrated into an air gun (e.g., the air gun 100A as described above in connection with FIG. 1A). In some embodiments, the pump body assembly B1 is a single-stage air pump (e.g., the pump body assembly B1 as described above in connection with FIG. 1B, FIG. 1B') configured to compress air in a single stage In some embodiments, the pump body assembly B1 is a multi-stage air pump (e.g., the pump body assembly B1 as described above in connection with FIG. 1C, FIG. 1C', FIG. 1D, and FIG. 1D) configured to sequentially compress air in multiple stages. The pump body assembly B1 includes various internal components such as pistons and chambers designed to increase the air pressure efficiently, which is described in detail below in connection with FIG. 3.

The gearbox assembly B2 (e.g., the gearbox assembly B2 as described above in connection with FIG. 1A) may include a set of bevel gears, including a large bevel gear and a small bevel gear, which will be described in detail in connection with FIG. 4. The motor B3 (e.g., the motor B3 as described above in connection with FIG. 1A) may be a high-speed direct current (DC) motor that is powered by a rechargeable battery. The motor B3 is configured to drive the onboard electric pump assembly to effectively draw and compress air.

The motor B3 is equipped with control features such as preset pressure settings, automatic stop upon reaching a target pressure, overload protection, and quick battery replacement capabilities, which will be described in detail in connection with FIG. 5*a*-FIG. 5*c*. The controller B4 (e.g., the controller B4 as described above in connection with FIG. 1A) is programmable and is operable by a user through a user interface. The controller B4 has features for monitoring and controlling the performance of the onboard electric pump assembly 200. In some embodiments, the controller B4 has an intelligent digital display that shows air pressure in multiple pressure units. In some embodiments, the controller B4 may also include a charging interface. The features of the controller B4 will be described in detail in connection with FIG. 5*a*-FIG. 5*c*.

Figure 3:
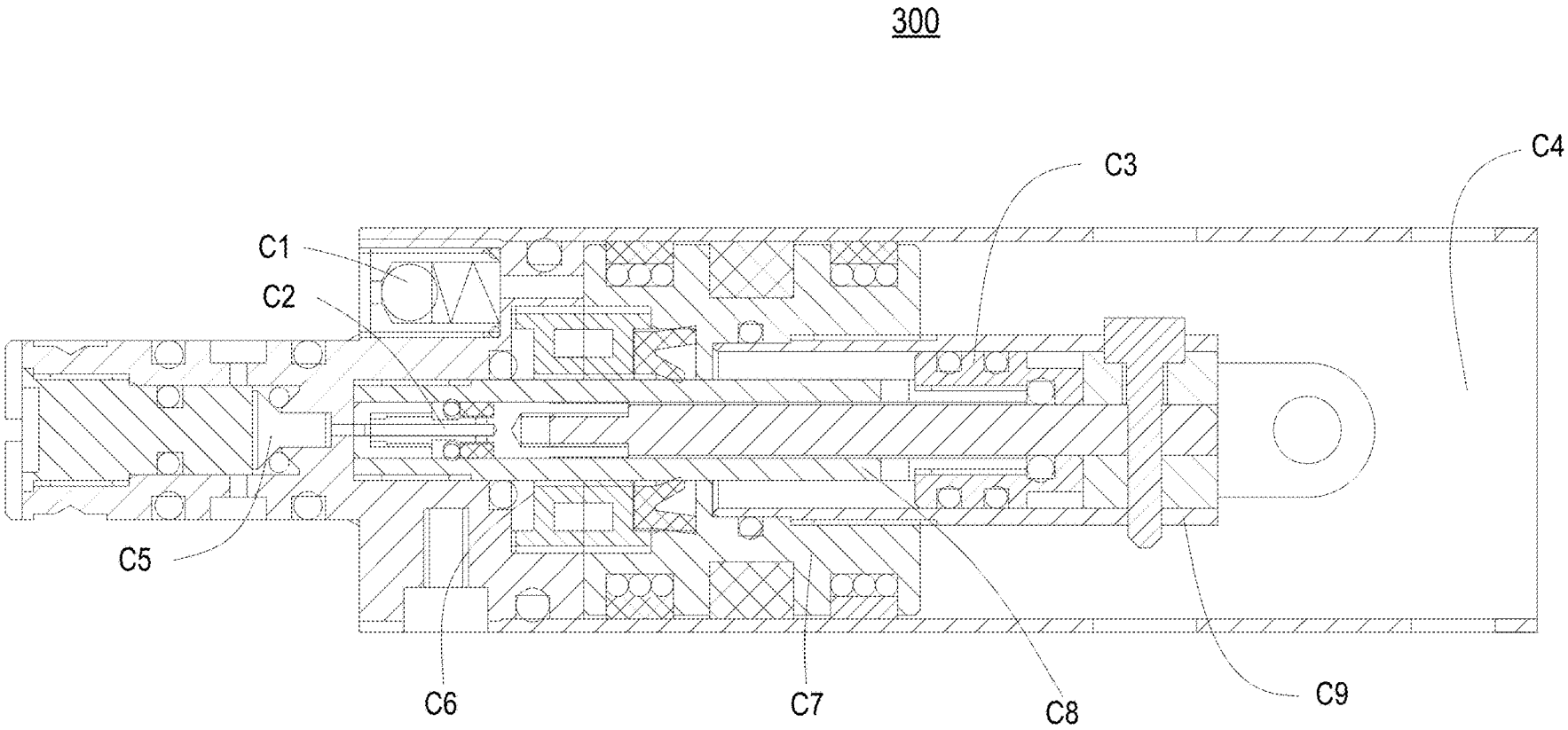
FIG. 3 illustrates a pump body assembly, in accordance with some embodiments of the present disclosure.

FIG. 3 illustrates a pump body assembly of an onboard electric pump 300 (e.g., as an embodiment of the onboard electric pump assembly 200 as described above in connection with FIG. 2), in accordance with some embodiments of the present disclosure. As shown in FIG. 3, pump body assembly 300 may include: air intake one-way valve C1, three-stage piston C2, third-stage tube connection sleeve C3, high-pressure one-way valve C5, fixed connection sleeve C6, mobile connection sleeve C7, and multiple-stage tubes. The multiple-stage tubes may include first-stage tube C4, third-stage tube C8, and second-stage C9.

The air intake one-way valve C1 is in communication with the first-stage tube C4 and allows atmospheric air to enter the pump body assembly 300 while preventing backflow. The third-stage piston C2 moves linearly and compresses the air within the pump body assembly 300. The third-stage tube connection sleeve C3 connects the third-stage tube to the pump body assembly 300, ensuring that air is properly directed through the compression stages. The first-stage tube C4 is the outermost and largest tube, enclosing other tubes. The second-stage tube C9 is enveloped by the first-stage tube C4 and itself envelops the third-stage tube C8. The second-stage tube C9 serves as an intermediate stage in the air compression process. The third-stage tube C8 is where the final stage of air compression occurs before the compressed high-pressure air is discharged to an air tube assembly of the air gun (e.g., the air tube assembly A4 as described above in connection with FIG. 1A) through the high-pressure one-way valve C5.

While the described example of the pump body assembly 300 utilizes three-stage tubes, the scope of this disclosure includes single-stage, two-stage, three-stage, four-stage, and other multi-stage tubes, as their principles align with the design concept. That is, the onboard electric pump can be used as a single-stage pump, a two-stage pump, a three-stage pump, a four-stage pump, or other multi-stage pumps, all of which fall within the scope of protection. This flexibility allows for a wide range of implementations, providing adaptability for different performance requirements.

The high-pressure one-way valve C5 is positioned between the third-stage tube and the air tube assembly, preventing the compressed air from flowing back into the third-stage tube C8, ensuring that the high-pressure air is retained in the air tube assembly. The fixed connection sleeve C6 holds different components of the pump body assembly 300 in place, providing structural integrity. The mobile connection sleeve C7 is mechanically linked to a connector of the second-stage tube C9. When the mobile connection sleeve C7 moves in a linear reciprocating manner, causing the pump body assembly 300 to draw air from the atmosphere through the air intake one-way valve C1 and sequentially compressing the air into the first-stage tube C4, the second-stage tube C9, and the third-stage tube C8. In some embodiments, the multiple stage tubes may include two stages of tubes, four stages of tubes, or five stages of tubes, which is not limited herein. In some embodiments, the pump body assembly 300 may include a single-stage tube, and air is compressed in the single-stage tube to a predetermined level before being discharged into the air tube assembly.

In some embodiments, the operation of the pump body assembly 300 may involve the following steps.

Air intake: the mobile connection sleeve C7 moves, creating a reciprocating linear motion that draws air through the air intake one-way valve C1 into the first-stage tube C4.

Air compression: as the mobile connection sleeve C7 moves to the left, it compresses the air in the first-stage tube C4 into the second-stage tube C9, and sequentially compresses the air in the second-stage tube C9 into the third-stage tube C8.

Further air compression: when the mobile connection sleeve C7 moves further to the left, the air in the third-stage tube C8 is further compressed by the third-stage piston C2.

Air storage: through continuous reciprocating motion of the mobile connection sleeve C7, high-pressure air is formed in the third-stage tube C8, and the high-pressure air is pushed into the air tube assembly of the air gun after reaching a predetermined level, with the high-pressure one-way valve C5 preventing any backflow, such that high-pressure air is stored in the air tube assembly.

In some embodiments, when the pump body assembly 300 includes the single-stage tube as described above, air is compressed only in the single-stage tube. As the mobile connection sleeve C7 moves back and forth from the right to the left, the air is sequentially compressed in the single-stage tube by the third-stage piston C2 to reach the predetermined level.

In some embodiments, when the pump body assembly 300 includes the two-stage tube as described above, the air is compressed in two stages to reach the predetermined level.

Figure 4:
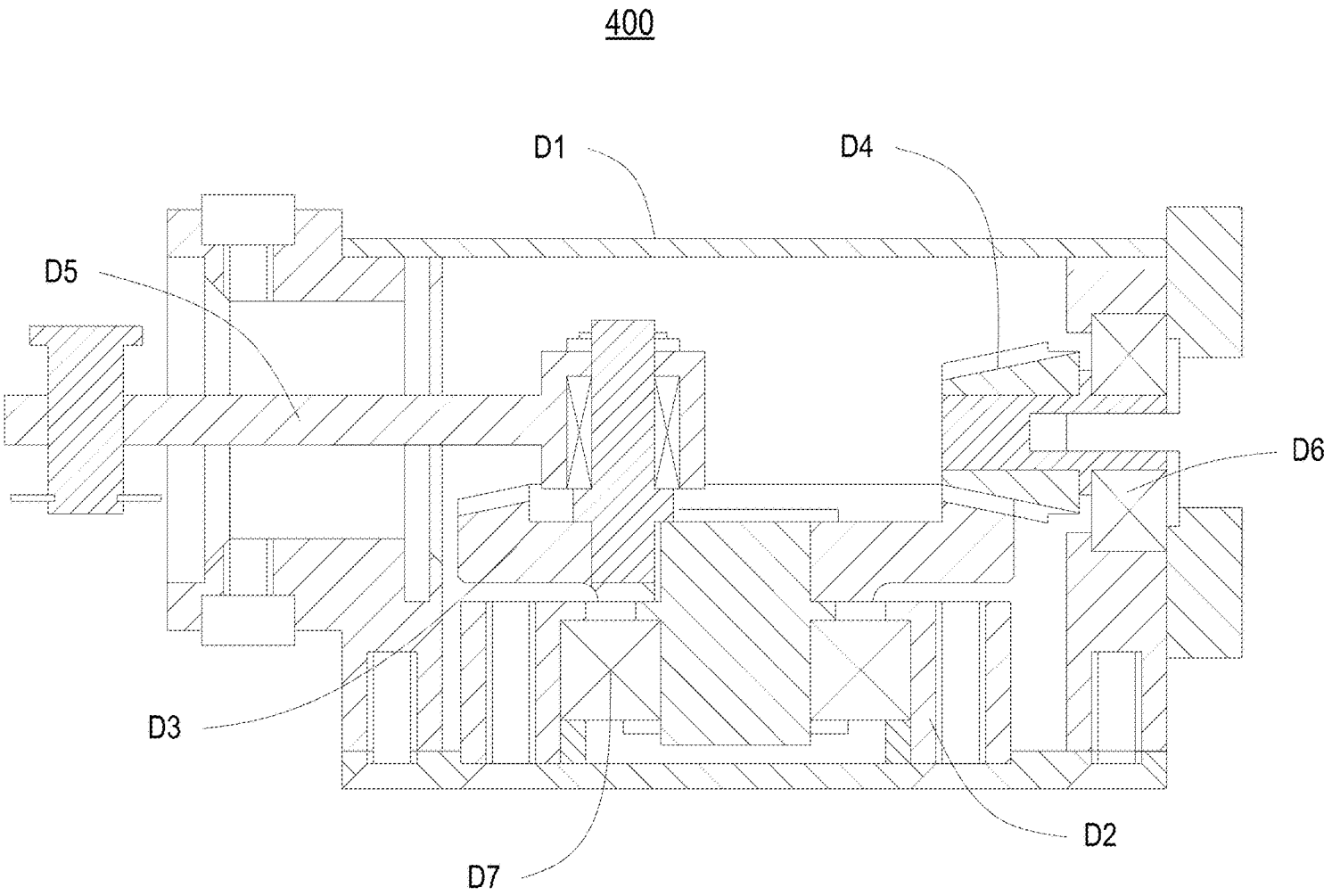
FIG. 4 illustrates a gearbox assembly, in accordance with some embodiments of the present disclosure.

FIG. 4 illustrates a gearbox assembly of an onboard electric pump assembly (e.g., the onboard electric pump assembly 200 as described above in connection with FIG. 2), in accordance with some embodiments of the present disclosure.

As shown in FIG. 4, gearbox assembly 400 may include: gearbox housing D1, first bearing support D2, first bevel gear D3, second bevel gear D4, connecting rod D5, second bearing D6, and first bearing D7. The gearbox housing D1 encases the internal components of the gearbox assembly 400, providing protection and structural support. The gearbox housing D1 ensures that the gears and other components of the gearbox assembly 400 are securely held in place and operate smoothly. The first bearing support D2 is configured to hold and support the first bearing D7, ensuring that the first bearing D7 remains properly aligned and rotates smoothly. The first bevel gear D3 is larger than the second bevel gear D4. The second bevel gear D4 is connected to an output shaft of a motor (e.g., the high-speed DC motor B3 as described above in connection with FIG. 2). When the motor drives the second bevel gear D4, the second bevel gear D4 drives the first bevel gear D3 to rotate. The rotation of the first bevel gear D3 is further converted into linear reciprocating motion by the connecting rod D5 that is attached to the first bevel gear D3. The linear reciprocating motion drives the on-board electric pump assembly to draw and compress air in multi-stage tubes (e.g., the first-stage tube C4, the second-stage C9, and the third-stage tube C8 as described above in connection with FIG. 3). The second bearing D6 supports the second bevel gear D4, ensuring that it rotates smoothly and efficiently. The first bearing D7 supports the first bevel gear D3, allowing it to rotate smoothly.

In some embodiments, the operation of the gearbox assembly 400 may involve the following steps.

Motor activation: when a motor (e.g., the motor B3 as described above in connection with FIG. 2) is activated, it drives the second bevel gear D4 to rotate because the motor's output shaft is connected to the second bevel gear D4.

Gear interaction: The rotation of the second bevel gear D4 drives the first bevel gear D3 to rotate. This interaction between the first and second gears is facilitated by the second bearing D6 and first bearing D7, which ensure smooth and efficient rotation.

Conversion of circular motion to linear motion: the rotation of the first bevel gear D3 is converted into linear reciprocating motion by the connecting rod D5. The circular motion of the first bevel gear D3 is translated into a back-and-forth linear motion of the connecting rod D5.

Driving pumping actions: the linear reciprocating motion of the connecting rod D5 drives pumping actions of a pump body assembly (e.g., the pump body assembly 300 as described above in connection with FIG. 3), compressing air in multi-stage tubes of the pump body assembly (e.g., the first-stage tube C4, the second-stage C9, and the third-stage tube C8 as described above in connection with FIG. 3). In some embodiments, when the pump body assembly includes the single-stage tube as described above, air is compressed only in the single-stage tube to reach a predetermined level. In some embodiments, when the pump body assembly includes the two-stage tube as described above, the air is compressed in two stages to reach the predetermined level.

While the onboard electric pump assembly is described using two bevel gears (D3 and D4), all gears capable of achieving a reduction in speed are within the scope of protection, as their principles fall within the design concept. This means that any gear mechanism that can perform the function of reducing speed, regardless of its specific configuration, is considered part of the inventive idea and is covered by the protection provided by this disclosure. The versatility in the choice of gears ensures that the design can accommodate various implementations while maintaining the essential functionality of the air pump assembly.

Figures 5A, 5B:
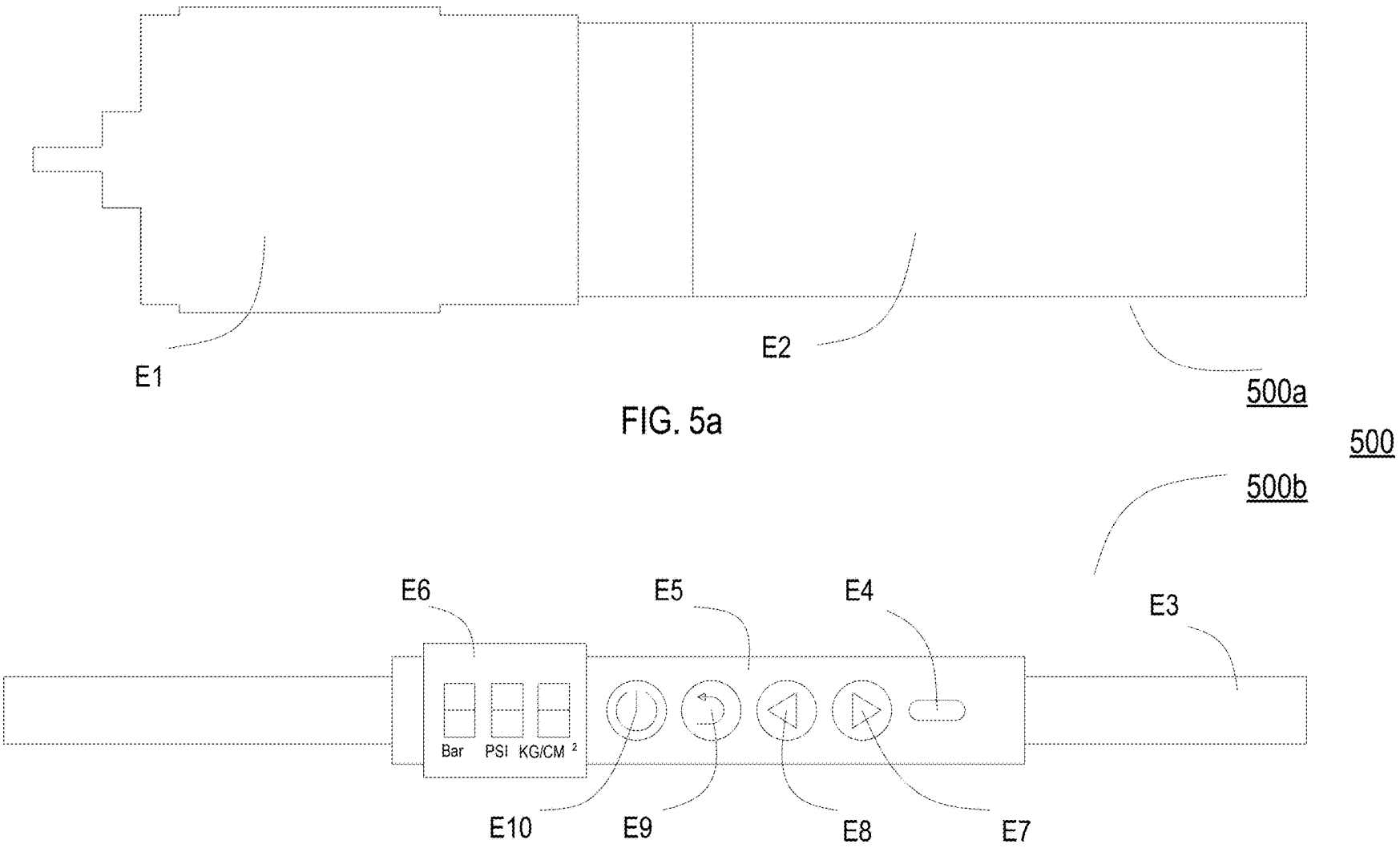
FIG. 5*a* and FIG. 5*b* illustrate a motor, battery, and control assembly, in accordance with some embodiments of the present disclosure.

FIG. 5*a* and FIG. 5*b* illustrate a motor, battery, and control assembly 500 of an onboard electric pump assembly (e.g., the onboard electric pump assembly A9 as described above in connection with FIG. 1A), in accordance with some embodiments of the present disclosure. FIG. 5*c* illustrates a block diagram of a control and pressure monitor system for the onboard electric pump assembly, in accordance with some embodiments of the present disclosure. FIG. 5*a*, FIG. 5*b*, and FIG. 5*c* will be described together.

As shown in FIG. 5*a*, the motor, battery, and control assembly 500 includes motor/battery 500*a* that includes motor E1 and battery E2. In some embodiments, the motor E1 is a high-speed direct current (DC) motor, which is configured to drive the pump and can operate at different voltages (e.g., 12V, 24V, 36V) based on practical applications. The speed and power of the motor E1 can be adjusted according to desired pressure outputs. The battery E2 supplies power to the motor E1. In some embodiments, the battery E2 is rechargeable.

As shown in FIG. 5*b*, the motor, battery, and control assembly 500 may also include controller 500*b*. The controller 500*b* may include circuit board support E3, charging interface E4, circuit board E5, display screen E6, and a set of control buttons. The set of control buttons may include down adjustment button E7, up adjustment button E8, return button E9, and on/off button E10. The circuit board support E3 is configured to mount the circuit board E5 onto an air gun (e.g., the air gun 100A as described above in connection with FIG. 1A). The charging interface E4 is incorporated into the circuit board E5 for recharging the battery E2, providing a convenient and efficient way to maintain the battery power. The circuit board E5 includes various control elements and is configured for managing the operation of the motor E1 and monitoring the air pressure. In some embodiments, the circuit board E5 is connected to a processor (e.g., processor 510 as shown in FIG. 5*c*), and the processor is configured to control the start and stop of the motor E1. The display screen E6 may be made from liquid crystals and is configured to digitally show preset pressure values and real-time pressure values with multiple selectable pressure units (e.g., Bar, PSI, KG/CM$^2$). The down adjustment button E7 is used to decrease the preset pressure value. The up adjustment button E8 is used to increase the preset pressure value. The return button E9 allows a user to navigate back through a control menu. The on/off button E10 is used to turn the motor E1 on and off.

In some embodiments, the display screen E6 is a touch screen, which provides an intuitive and user-friendly interface for controlling various functions of the air gun. The touch screen functionality allows users to easily interact with the onboard electric pump assembly and the controller 500*b* by simply tapping or swiping on the display screen. This interface can be used to perform the following operations.

Setting target pressure: users can input the desired target air pressure for the air tube assembly directly on the touch screen. This eliminates the need for physical buttons or dials, making the process more straightforward and precise.

Monitoring pressure levels: the touch screen can display real-time pressure readings from the pressure sensors, providing users with immediate feedback on the current status of the air tube assembly and the multiple-stage tubes.

Accessing menus and settings: users can navigate through various menus and settings related to the operation of the air gun. This includes accessing a pressure monitor system (will be described in detail below in connection with FIG. 5*c*) settings, adjusting the motor speed, and configuring alerts for maintenance or safety.

Displaying notifications: important notifications, such as alerts for reaching the target pressure, low battery warnings, or maintenance reminders, can be prominently displayed on the touch screen, ensuring that users are always informed of the air gun's status.

Enhancing visualization: the touch screen can show graphical representations of pressure trends, battery levels, and other critical data, providing a more comprehensive and visually appealing way to monitor and control the air gun's functions.

Customization: users can customize the interface, such as choosing preferred pressure units (e.g., Bar, PSI, KG/CM$^2$), adjusting display brightness, or setting up personalized profiles for different shooting scenarios.

The integration of a touch screen enhances the overall user experience, and also adds a layer of sophistication to the air gun, making it more appealing to users who prefer modern, interactive devices.

Figure 5C:
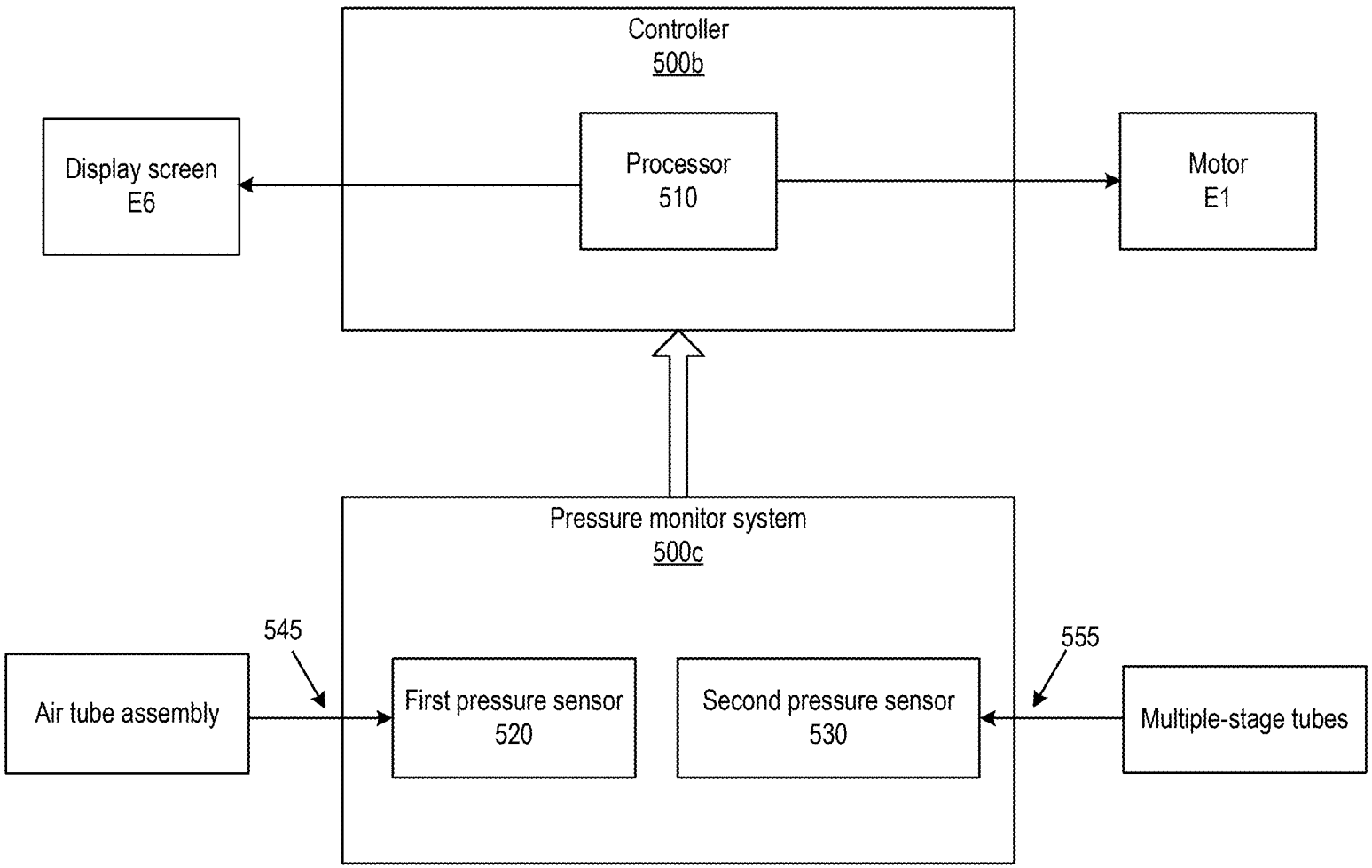
FIG. 5*c* illustrates a block diagram of a controller and a pressure monitor system for the onboard electric pump assembly, in accordance with some embodiments of the present disclosure.

As shown in FIG. 5*c*, in some embodiments, the controller 500*b* is connected to a pressure monitor system 500*c* that is configured to monitor the pressure inside an air tube assembly of an air gun (e.g., the air tube assembly of the air gun A4 as described as above in connection with FIG. 1A) and/or monitor the pressure inside multi-stage tubes (e.g., the first-stage tube C4, the second-stage C9, and the third-stage tube C8 as described above in connection with FIG. 3). The pressure monitor system 500*c* detects the pressure, transmits data to the controller 500*b*, which in turn displays the detected pressure on the display screen E6.

The controller 500*b* may include a processor 510 that manages the operations of motor E1 via a control signal transmitted through line 505. The motor E1 drives the multiple-stage tubes for air compression.

The pressure monitor system 500*c* is integral to maintaining optimal pressure levels within the air tube assembly and the multiple-stage tubes. In some embodiments, the pressure monitor system 500*c* includes a first pressure sensor 520 and a second pressure sensor 530. The first pressure sensor 520 is connected to the air tube assembly via line 545, monitoring the pressure within the air tube assembly. The second pressure sensor 530 is connected to the multiple-stage tubes via line 555, monitoring the pressure within the multiple-stage tubes.

In some embodiments, the first pressure sensor 520 is embedded directly within the air tube assembly, while still being connected to the pressure monitor system 500*c*. This integration allows for real-time, precise monitoring of the internal pressure without the potential delay or inaccuracies that could arise from external connections. By being situated within the air tube assembly itself, the first pressure sensor can provide immediate feedback on the air pressure, ensuring that the system responds promptly to any changes.

In some embodiments, the second pressure sensor 530 is embedded directly within the multiple-stage tubes, maintaining its connection to the pressure monitor system 500*c*. This placement ensures that the pressure within the multi-stage tubes is accurately monitored. Direct integration of the second pressure sensor 530 within the multiple-stage tubes allows for precise control over the compression process.

In some embodiments, the second pressure sensor 530 includes a plurality of pressure sensors, with each stage of the multi-stage tubes being monitored by an individual pressure sensor. This configuration provides a detailed pressure profile for each stage, allowing the pressure monitor system 500*c* to accurately track and control the compression process, which further provides the controller 500*b* with comprehensive data about the pressure at each stage of compression, enabling the controller 500*b* to fine-tune the pump operation, potentially increasing efficiency and reducing wear on the pump components. For example, when a specific stage is detected to be underperforming or overpressurized, the controller 500*b* can adjust the speed of the motor E1, ensuring that the desired pressure levels are achieved consistently.

In some embodiments, the controller 500*b* and the pressure monitor system 500*c* work together to enable the following operational features.

Predetermining pressure: a user can predetermine a desired pressure level using the down adjustment button E7 and up adjustment button E8, with the predetermined pressure values being displayed on the display screen E6.

Start the motor in response to user inputs: in response to a first input from the user, the controller is configured to start the motor E1 to charge the air tube assembly. In some embodiments, the first input may be an input of pressing the on/off button E10 by the user. In some embodiments, the first input may be an input of pressing the up adjustment button E8 by the user. In some embodiments, the first input may be an input provided through the touch screen as described above. The touch screen can present a virtual button or icon that the user can press to initiate the motor E1. This virtual button may be labeled with an appropriate icon or text indicating its function, such as "Start Charging" or a power on symbol. The touch screen can also provide additional interactive elements that guide the user through the process of starting the motor, setting target pressure levels, offering visual feedback to confirm that the input has been received and the motor is starting. The use of a touch screen allows for a more versatile and user-friendly interface, enabling users to easily control the air gun's functions with intuitive touch gestures.

Stop the motor in response to user inputs: in response to a second input from the user, the controller is configured to stop the motor E1 to stop charging the air tube assembly. In some embodiments, the second input may be an input of pressing the on/off button E10 by the user. In some embodiments, the second input may be an input of pressing the down adjustment button E8 by the user. In some embodiments, the second input may be an input provided through the touch screen as described above. The touch screen can present a virtual button or icon that the user can press to stop the motor E1. This virtual button may be labeled with an appropriate icon or text indicating its function, such as "Stop Charging" or a power off symbol.

Detecting pressure drop: the first pressure sensor 520 continuously monitors the pressure in the air tube assembly. When it detects a pressure drop below a first threshold value, it signals the pressure monitor system 500*c*.

Automatic start: once the signal of pressure drops to the first threshold value in the air tube assembly is transmitted to the controller 500*b*, the controller 500*b* automatically starts the motor E1 to start charging air into the air tube assembly. This process continues until the pressure in the air tube assembly reaches the predetermined pressure level.

Monitoring pressure in the multi-stage tubes: the second pressure sensor 530 monitors the pressure in one or more tubes of the multiple-stage tubes. This ensures that the air pumping process is functioning correctly and efficiently.

Automatic stop: once the pressure reaches the predetermined pressure level in the air tube assembly, the first pressure sensor 520 sends a signal to the pressure monitor system 500*c*, which then transmit the signal to the controller 500*b*, and the controller 500*b* automatically stops the motor E1.

Overload protection: once the pressure reaches a second threshold value (which is higher than the first threshold value but may be lower than the predetermined pressure level set by the user) in the air tube assembly, the controller 500*b* automatically stops the motor E1 to prevent overcharging and ensure safety of the air tube assembly.

Intelligent display: The display screen E6 displays real-time data with options to select a pressure unit from multiple pressure units, making it user-friendly and easy to understand.

Battery management: the charging interface E4 enables convenient recharging of the battery E2, ensuring that the motor, battery, and control assembly 500 remains operational with minimal downtime.

Figure 6:
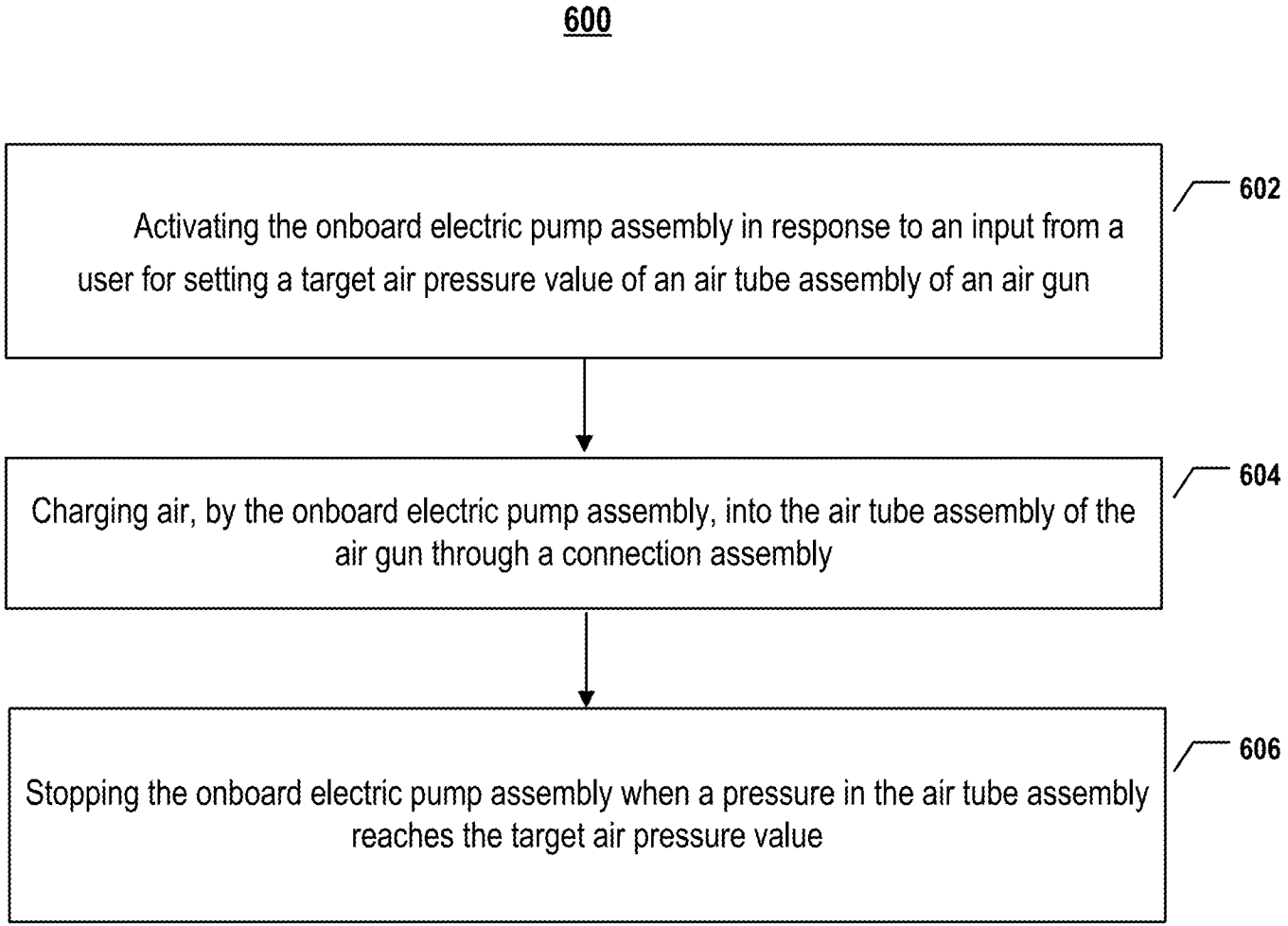
FIG. 6 is a flowchart of an exemplary method for charging an air gun equipped with an onboard electric pump assembly, in accordance with some embodiments of the present disclosure.

FIG. 6 is a flowchart of an exemplary method for charging an air gun equipped with an onboard electric pump assembly, in accordance with some embodiments of the present disclosure. As shown in FIG. 6, method 600 includes steps 602, 604, and 606. It is contemplated that method 600 may include more steps beyond steps 602-606, or some of the described steps 602-606 may be optional.

Step 602 involves activating an onboard electric pump assembly (e.g., the onboard electric pump assembly A9 as described above in connection with FIG. 1A) in response to an input from a user for predetermining a target air pressure level of an air tube assembly of the air gun (e.g., the air tube assembly A4 as described above in connection with FIG. 1A). The user may predetermine a desired value of the target air pressure using a control interface. The predetermined value may be input by the user in various different ways. In some embodiments, the input may be made by operating the down adjustment button E7 and the up adjustment button E8 as described above in connection with FIG. 5. In additional embodiments, other input methods may be implemented, such as having the user directly type in the value, presenting multiple values for the user to select on the screen, or voice instructions. The input may also be made through a touch screen (e.g., the touch screen described above in connection with FIG. 5*a*-FIG. 5*c*). The predetermined desired value of the target air pressure may be input in various formats. In some embodiments, the value may be in a numerical form indicating the pressure itself, a percentage level of a maximum pressure, or a discrete indicator of the pressure level (for example, numbers 1-5 indicating different pressure scales).

A controller (e.g., the controller 500*b* as described above in connection with FIG. 5*c*) may process the user input and initiate the charging process. In some embodiments, the activation of the onboard electric pump assembly can also be initiated by the dropping of air pressure inside the air tube assembly to a first threshold value, and the dropping of air pressure may be monitored by a pressure monitor system (e.g., the pressure monitor system 500*c* described above in connection with FIG. 5*c*).

Step 604 involves charging air, by the onboard electric pump assembly, into the air tube assembly of the air gun. The onboard electric pump assembly, equipped with multi-stage tubes (e.g., the first-stage tube C4, the second-stage C9, and the third-stage tube C8 as described above in connection with FIG. 3), draws atmospheric air, compresses it sequentially, and directs the high-pressure air into the air tube assembly. In some embodiments, when the pump body assembly includes the single-stage tube as described above, air is compressed only in the single-stage tube to reach a predetermined level. In some embodiments, when the pump body assembly includes the two-stage tube as described above, the air is compressed in two stages to reach the predetermined level.

Step 606 involves stopping the onboard electric pump assembly when the pressure in the air tube assembly reaches the target air pressure level. The controller (e.g., the controller 500*b* as described above in connection with FIG. 5) obtains real-time data from a first pressure sensor of a pressure monitor system (e.g., the pressure monitor system described above in connection with FIG. 5*b*) about the pressure level within the air tube assembly. Once the target air pressure level is reached, the controller automatically stops the onboard electric pump assembly to prevent overcharging and ensure user safety. In some embodiments, when the first pressure sensor detects that the air pressure in the air tube assembly reaches a second threshold value that is higher than the first threshold value, the controller automatically stops the pump regardless of whether the target value set by the user is reached.

In some embodiments, step 606 also involves stopping the onboard electric pump assembly when the pressure in the multi-stage tubes is too high. The controller (e.g., the controller 500*b* as described above in connection with FIG. 5*c*) obtains real-time data from a second pressure sensor of a pressure monitor system (e.g., the pressure monitor system described above in connection with FIG. 5*b*) about the pressure level within the multi-stage tubes. Once a preset warning pressure level is reached, the controller automatically stops the onboard electric pump assembly to prevent overcharging of the multi-stage tubes.

Figure 7:
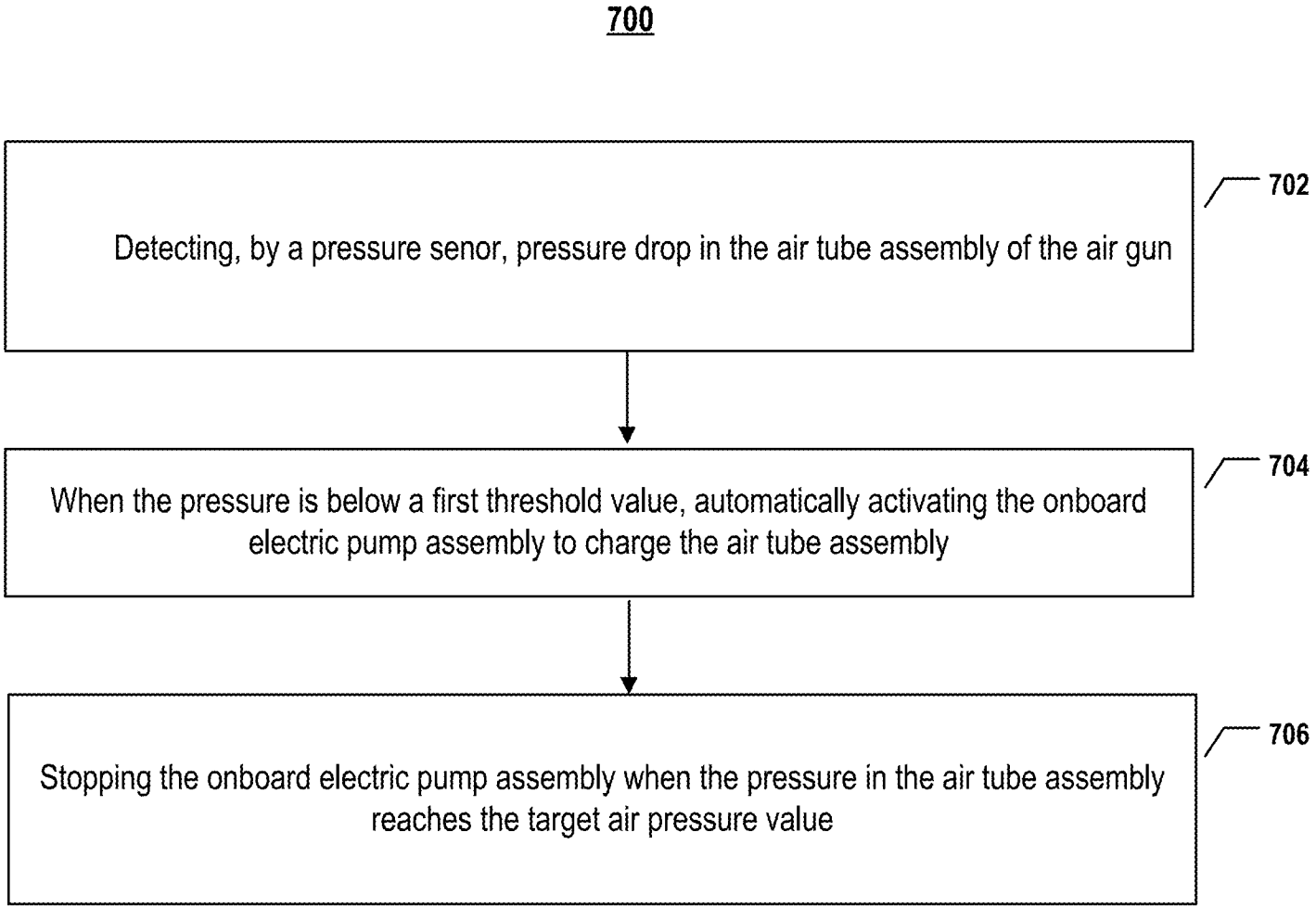
FIG. 7 is a flowchart of an exemplary method for automatically maintaining air pressure in an air tube assembly of an air gun equipped with an onboard electric pump assembly, in accordance with some embodiments of the present disclosure.

FIG. 7 is a flowchart of an exemplary method for automatically maintaining air pressure in an air tube assembly of an air gun equipped with an onboard electric pump assembly, in accordance with some embodiments of the present disclosure. As shown in FIG. 7, method 700 includes steps 702, 704, and 706. It is contemplated that method 700 may include more steps beyond steps 702-706, or some of the described steps 702-706 may be optional.

Step 702 involves detecting, by a first pressure sensor of a pressure monitor system (e.g., the first pressure sensor 520 and the pressure monitor system 500*c* as described above in connection with FIG. 5*c*), a pressure drop in an air tube assembly of an onboard electric pump assembly (e.g. the air tube assembly A4 as described above in connection with FIG. 1A). The pressure monitor system continuously monitors the air pressure within the air tube assembly and transmits data to a controller (e.g., the controller 500*b* described above in connection with FIG. 5*c*). When the pressure drops below a first threshold (e.g., the first threshold as described above in connection to method 600), the controller initiates necessary actions to recharge the air tube assembly.

Step 704 involves automatically activating an onboard electric pump assembly (e.g., the onboard electric pump assembly A9 as described above in connection with FIG. 1A) to charge the air tube assembly when the pressure is below the first threshold value. Upon detecting that the air pressure has fallen below the first threshold value, the controller automatically activates the onboard electric pump assembly. This activation process involves starting a motor (e.g., the motor E1 as described above in connection with FIG. 5*a*) and engaging a multi-stage air pumping assembly (which may include, e.g., the first-stage tube C4, the second-stage C9, and the third-stage tube C8 as described above in connection with FIG. 3) to begin compressing air into the air tube assembly. In some embodiments, the controller controls an operating voltage of the motor to adjust based on different target pressure inside the air tube assembly.

Step 706 involves stopping the onboard electric pump assembly when the pressure in the air tube assembly reaches the target air pressure value. The controller monitors the pressure increase within the air tube assembly as it is being charged. Once the target air pressure value is reached, the controller automatically stops the onboard electric pump assembly, preventing overcharging of the air tube assembly.

Figure 8:
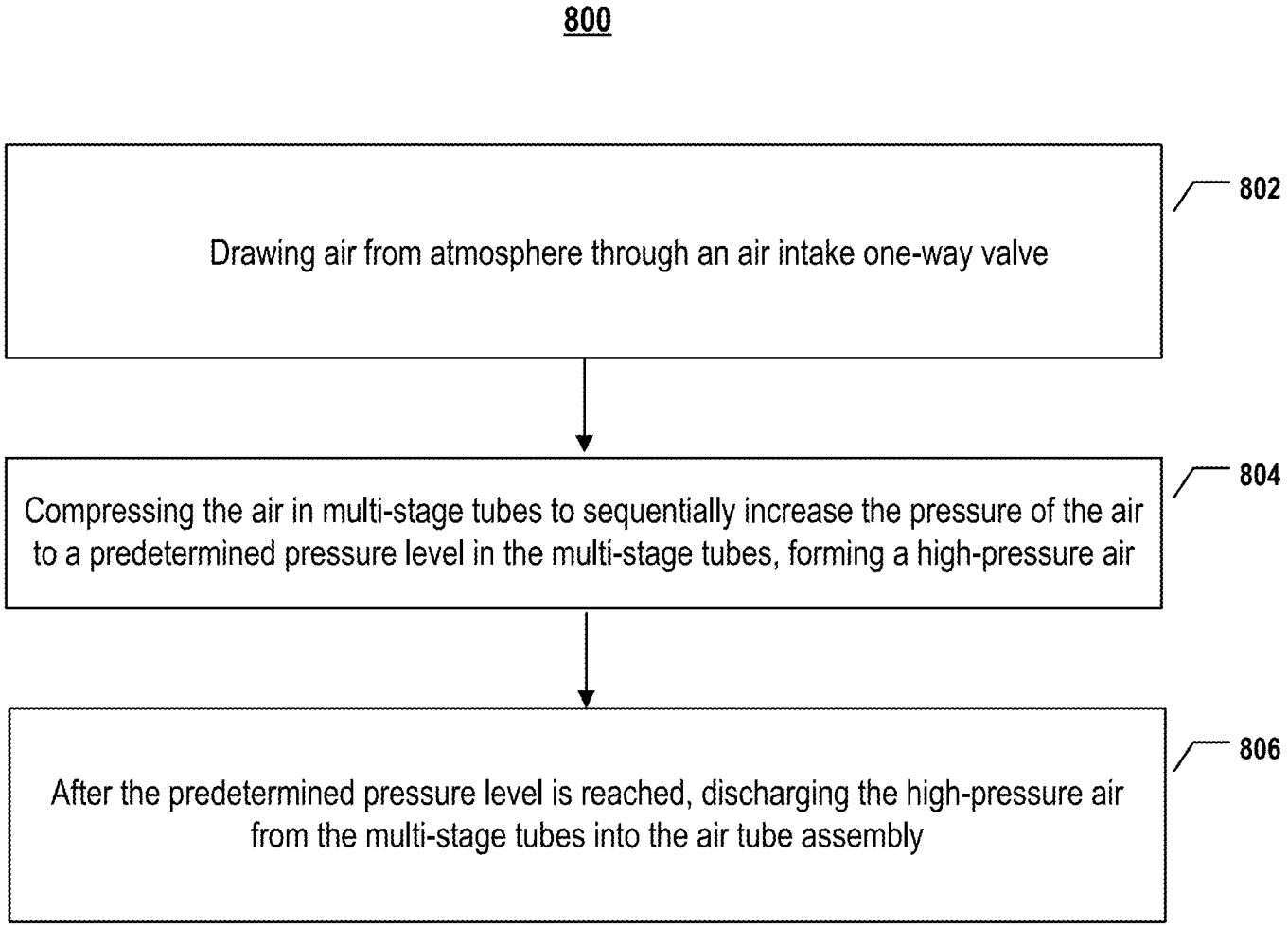
FIG. 8 is a flowchart of an exemplary method for compressing air using a multi-stage air pumping assembly and discharging high-pressure air into an air tube assembly of an air gun equipped with an onboard electric pump assembly, in accordance with some embodiments of the present disclosure.

FIG. 8 is a flowchart of an exemplary method for compressing air using a multi-stage air pumping assembly and discharging high-pressure air into an air tube assembly of an air gun equipped with an onboard electric pump assembly, in accordance with some embodiments of the present disclosure. As shown in FIG. 8, method 800 includes steps 802, 804, and 806. It is contemplated that method 800 may include more steps beyond steps 802-806, or some of the described steps 802-806 may be optional.

Step 802 involves drawing air from the atmosphere through an air intake one-way valve (e.g., the air intake one-way valve C1 as described above in connection with FIG. 3) into a multi-stage air pumping assembly of an air gun (e.g., air gun 100A as described above in connection with FIG. 1A), which may include multi-stage tubes (e.g., the first-stage tube C4, the second-stage C9, and the third-stage tube C8, as described above in connection with FIG. 3). The air intake one-way valve ensures that the air flow is unidirectional, preventing any backflow that could compromise the efficiency of a pumping process.

Step 804 involves compressing the air in the multi-stage tubes to sequentially increase the pressure of the air to a predetermined pressure level in the multi-stage tubes, forming high-pressure air. The multi-stage tubes are interconnected, configured to incrementally increase the pressure of the air. The air passes through each tube and is sequentially compressed, raising its pressure until a target high-pressure level is achieved.

Step 806 involves, after the predetermined pressure level is reached, discharging the high-pressure air from the multi-stage tubes into an air tube assembly (e.g., the air tube assembly A4 as described above in connection with FIG. 1A). Upon reaching the desired pressure level, the high-pressure air is discharged from the multi-stage tubes and directed into the air tube assembly. A high-pressure one-way valve (e.g., the high-pressure one-way valve C5 as described above in connection with FIG. 3) may be used to prevent the backflow of air, ensuring that the compressed air is efficiently transferred to the air tube assembly. The air tube assembly stores the high-pressure air, until a first pressure sensor of a pressure monitor system (e.g., the first pressure sensor as described above in connection with method 600) detects that the pressure level inside the air tube assembly reaches a predetermined pressure level, making it available for use by the air gun.

In some embodiments, discharging the high-pressure air into the air tube assembly includes opening the high-pressure one-way valve between the multi-stage tubes and the air tube assembly, where the high-pressure one-way valve is in a closed state when the air is being compressed in the multi-stage tubes; and discharging the high-pressure air into the air tube assembly through the opened high-pressure one-way valve.

In some embodiments, method 800 further includes detecting air pressure in the multi-stage tubes by a second pressure sensor of a pressure monitoring system (e.g., the pressure monitor system described above in connection with FIG. 5*c*), and stopping compressing the air in the multi-stage tubes when the air pressure in the multi-stage tubes reaches a preset warning pressure.

In some embodiments, the onboard electric pump assembly includes a gearbox assembly (e.g., the gearbox assembly 400 as described above in connection with FIG. 4). The gearbox assembly may include a first bevel gear (e.g., the first bevel gear D3 as described above in connection with FIG. 4) connected to an output shaft of a motor (e.g., the motor E1 as described above in connection with FIG. 5*a*-FIG. 5*c*), a second bevel gear (e.g., the second bevel gear D4 as described above in connection with FIG. 4) connected to the first bevel gear, and a connecting rod (the connecting rod D5 as described above in connection with FIG. 4) affixed to the second bevel gear. Forming the high-pressure air may include: starting the motor; rotating the first bevel gear driven by a movement of the output shaft of the motor; rotating the second bevel gear driven by a movement of the first bevel gear; translating rotation of the second bevel gear into linear reciprocating movement of the connecting rod; drawing air into the multi-stage tubes; and compressing the air into the high-pressure air in the multi-stage tubes.

In some embodiments, the onboard electric pump assembly includes a display screen (e.g., the display screen E6 as described above in connection with FIG. 5). Each of methods 600, 700, and 800 may include displaying: the first threshold value, the second threshold value, and instantaneous pressure values in the air tube assembly and the multi-stage tubes during charging the air tube assembly. Furthermore, each of methods 600, 700, and 800 may include displaying pressure in various units, Bar, PSI, $KG/CM^2$, etc. In some embodiments, the display may switch among or cycle through the values of different units upon user instruction (e.g., by pressing a button).

In some aspects of the present disclosure, a non-transitory computer-readable storage medium is provided. The non-transitory computer-readable medium contains stored thereon computer-executable instructions that, when executed by a processor of a controller (e.g., the controller 500*b* as described above in connection with FIG. 5*b*), cause the processor to perform operations for performing the foregoing described methods. To avoid repetition, details are not described herein again. The non-transitory computer-readable storage medium is, for example, a Read-Only Memory (ROM), a Random Access Memory (RAM), a magnetic disk, or an optical disc.

The foregoing description of various embodiments reveals the general nature of the present disclosure that others can, by applying knowledge within the skill of the art, readily modify and/or adapt, for various applications, such specific embodiments, without undue experimentation, and without departing from the general concept of the present disclosure. Therefore, such adaptations and modifications are intended to be within the meaning and range of equivalents of the disclosed embodiments, based on the disclosure and guidance presented herein. It is to be understood that the phraseology or terminology herein is for the purpose of description and not of limitation, such that the terminology or phraseology of the present specification is to be interpreted by the skilled artisan in light of the disclosure and guidance.

Embodiments of the present disclosure have been described above with the aid of functional building blocks illustrating the embodiment of specified functions and relationships thereof. The boundaries of these functional building blocks have been arbitrarily defined herein for the convenience of the description. Alternate boundaries can be defined so long as the specified functions and relationships thereof are appropriately performed.

The Summary and Abstract sections can set forth one or more but not all exemplary embodiments of the present disclosure as contemplated by the inventor(s), and thus, are not intended to limit the present disclosure and the appended claims in any way.

The breadth and scope of the present disclosure should not be limited by any of the above-described exemplary embodiments, but should be defined only in accordance with the following claims and their equivalents.

What is claimed is:

1. An air gun, comprising:

an air tube assembly;

an onboard electric pump assembly mounted within the air gun and connected to the air tube assembly, wherein the onboard electric pump assembly is configured to charge air into the air tube assembly, and the onboard electric pump assembly comprises a controller;

a valve assembly configured to control air flow and pressure within the air tube assembly;

a firing mechanism assembly operable by a user; and an air release valve assembly located between the air tube assembly and the firing mechanism assembly, wherein the air release valve assembly is configured to be triggered by the firing mechanism assembly to release the air in the air tube assembly to project pellets, wherein the onboard electric pump assembly comprises a multi-stage air pumping assembly configured to sequentially increase air pressure in multiple stages to a predetermined level before charging the air tube assembly, and the controller is connected to a pressure monitor system configured to:

monitor pressure in the multi-stage air pumping assembly; and monitor pressure in the air tube assembly.

2. The air gun according to claim 1, wherein the onboard electric pump assembly further comprises a gearbox assembly, wherein the gearbox assembly comprises a set of bevel gears configured to drive pumping actions for the multi-stage air pumping assembly.

3. The air gun according to claim 2, wherein the onboard electric pump assembly further comprises a battery and a DC motor powered by the battery.

4. The air gun according to claim 1, wherein the controller is configured to:

in response to a first input from the user on a user interface, start the DC motor to charge the air tube assembly.

5. The air gun according to claim 1, wherein the controller is configured to:

in response to a second input from the user on a user interface while the onboard electric pump assembly is charging the air tube assembly, stop the onboard electric pump assembly.

6. The air gun according to claim 1, wherein the controller is configured to:

in response to pressure drop in the air tube assembly below a first threshold value, start the onboard electric pump assembly to charge the air tube assembly.

7. The air gun according to claim 6, wherein the controller is configured to:

in response to the pressure in the air tube assembly reaches a second threshold value while the onboard electric pump assembly is charging the air tube assembly, automatically stop the onboard electric pump assembly, wherein the second threshold value is larger than the first threshold value.

8. The air gun according to claim 1, wherein the multi-stage air pumping assembly comprises a set of multi-stage tubes including:

a first-stage tube;

a second-stage tube enveloped by the first-stage tube; and a third-stage tube enveloped by the second-stage tube.

9. The air gun according to claim 8, wherein the onboard electric pump assembly further comprises:

an air intake one-way valve in communication with the first-stage tube; and a mobile connection sleeve, mechanically linked to a connector of the second-stage tube, wherein the mobile connection sleeve is configured to move in a linear reciprocating manner, drawing air from atmosphere to pass through the air intake one-way valve, then sequentially compressing the air into the first-stage tube, the second-stage tube, the third-stage tube, and the air tube assembly.

10. The air gun according to claim 9, further comprising a one-way valve configured to prevent the compressed air in the air tube assembly from flowing back into the third-stage tube.

11. The air gun according to claim 10, wherein the gearbox assembly comprises:

a first bevel gear connected to an output shaft of the DC motor of the onboard electric pump assembly;

a second bevel gear connected to the first bevel gear; and a connecting rod affixed to the second bevel gear, wherein:

the first bevel gear is smaller than the second bevel gear;

the first bevel gear is configured to rotate in response to movement of the output shaft of the DC motor;

the second bevel gear is driven to rotate by rotation of the first bevel gear; and the connecting rod is configured to translate rotation of the second bevel gear into linear reciprocating movement, enabling the multi-stage air pumping assembly to draw the air into the multi-stage tubes.

12. The air gun according to claim 1, wherein the controller comprises:

a circuit board, equipped with a user interface; and a circuit board bracket for mounting the circuit board onto the air gun.

13. The air gun according to claim 12, wherein the controller further comprises:

a display screen integrated into the circuit board, wherein the display screen is configured to display pressure in multiple units.

14. The air gun according to claim 13, wherein the controller further comprises:

a charging interface incorporated into the circuit board, wherein the charging interface is configured for charging the battery of the onboard electric pump assembly.

15. The air gun according to claim 1, wherein the controller is operable by the user through a user interface, wherein the user interface comprises a set of user interface controls comprising an up-adjustment button, a down-adjustment button, an on/off button, and a return button for user inputs.

16. The air gun according to claim 1, wherein the multi-stage air pump assembly comprises a two-stage air pumping assembly configured to sequentially increase air pressure in two stages to a predetermined level before charging the air tube assembly.

* * * * *